US007744242B2

(12) United States Patent
Krämer

(10) Patent No.: US 7,744,242 B2
(45) Date of Patent: Jun. 29, 2010

(54) SPOTLIGHT FOR SHOOTING FILMS AND VIDEOS

(75) Inventor: Regine Krämer, Munich (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 400 days.

(21) Appl. No.: 11/920,183

(22) PCT Filed: May 11, 2006

(86) PCT No.: PCT/DE2006/000813

§ 371 (c)(1),
(2), (4) Date: Dec. 18, 2007

(87) PCT Pub. No.: WO2006/119750

PCT Pub. Date: Nov. 16, 2006

(65) Prior Publication Data

US 2009/0046453 A1 Feb. 19, 2009

(30) Foreign Application Priority Data

May 11, 2005 (DE) ..... 10 2005 022 832

(51) Int. Cl.
*F21V 9/00* (2006.01)

(52) U.S. Cl. ..... 362/231; 362/84; 362/228; 362/242; 362/293; 362/800; 313/502; 313/503; 313/504

(58) Field of Classification Search ..... 362/84, 362/228, 231, 242, 293, 800; 313/502–45; 257/98–100

See application file for complete search history.

(56) References Cited

U.S. PATENT DOCUMENTS 5,952,681 A 9/1999 Chen (Continued)

FOREIGN PATENT DOCUMENTS

DE 90 15 115.1 U1 3/1991

(Continued)

OTHER PUBLICATIONS

Translation of the relevant parts of DE 90 15 115.1, previously filed Nov. 9, 2007.

(Continued)

*Primary Examiner*—Sandra L O'Shea
*Assistant Examiner*—Meghan K Dunwiddie
(74) *Attorney, Agent, or Firm*—Christie, Parker & Hale, LLP

(57) ABSTRACT

A spotlight for shooting films and videos is provided. The spotlight comprising light-emitting diodes (LEDs) arranged on a light-emitting surface, of which color LEDs emit different LED colors (R, G, A, B, Ye) and provide luminous flux portions for a color mixture. At least one LED comprises a luminescent LED. The spotlight further comprising a device for setting the luminous flux portion emitted by the LEDs, which device drives the LEDs at least in groups. At least one color LED emits the LED color "blue" or "cyan", and the luminescent LED comprises a yellow-green, daylight-white, neutral-white or warm-white luminescent LED, which covers at least a portion of the color LEDs with the exception of the color LED emitting the LED color "blue" or "cyan".

51 Claims, 29 Drawing Sheets

U.S. PATENT DOCUMENTS

| | | | |
|---|---|---|---|
| 6,127,784 | A | 10/2000 | Grossman et al. |
| 6,153,985 | A | 11/2000 | Grossman |
| 6,310,445 | B1 | 10/2001 | Kashaninejad |
| 6,435,459 | B1 | 8/2002 | Sanderson et al. |
| 6,513,949 | B1 | 2/2003 | Marshall et al. |
| 6,608,453 | B2 | 8/2003 | Morgan et al. |
| 6,636,003 | B2 | 10/2003 | Rahm et al. |
| 6,683,419 | B2 | 1/2004 | Kriparos |
| 6,692,136 | B2 | 2/2004 | Marshall et al. |
| 6,788,011 | B2 | 9/2004 | Mueller et al. |
| 6,890,085 | B2 | 5/2005 | Hacker |
| 2004/0036671 | A1 | 2/2004 | Hudson |
| 2004/0070562 | A1 | 4/2004 | Hudson et al. |
| 2004/0105261 | A1 | 6/2004 | Ducharme et al. |
| 2004/0113568 | A1 | 6/2004 | Dowling et al. |
| 2004/0124002 | A1 | 7/2004 | Mazzochette et al. |

FOREIGN PATENT DOCUMENTS

| | | | |
|---|---|---|---|
| DE | 100 48 447 | A1 | 5/2002 |
| DE | 102 16 394 | B3 | 1/2004 |
| DE | 102 33 050 | A1 | 2/2004 |
| DE | 102 60 232 | A1 | 7/2004 |
| WO | WO 97/48138 | | 12/1997 |
| WO | WO 00/19546 | | 4/2000 |
| WO | WO 01/36864 | A2 | 5/2001 |
| WO | WO 01/41215 | A1 | 6/2001 |
| WO | WO 2004/079790 | A2 | 9/2004 |
| WO | WO 2004/100275 | A1 | 11/2004 |

OTHER PUBLICATIONS

English Abstract of DE 100 48 447, previously filed Nov. 9, 2007.
English Abstract of DE 102 33 050, previously filed Nov. 9, 2007.
English Abstract of DE 102 60 232, previously filed Nov. 9, 2007.
English translation of International Preliminary Examination Report for corresponding PCT application No. PCT/DE2006/000813, dated Mar. 13, 2008.
International Search Report dated Dec. 22, 2006, Corresponding to PCT/DE2006/000813.
Dialight, "The Next Generation of LED Control," Farmingdale, NJ Apr. 8, 2004—LIGHTFAIR 2004.

(A - B)

(A-B)

(A - B)

(A- B)

(A - B)

(A - B)

Gamut of LED spotlight
with various LED combinations

SPOTLIGHT FOR SHOOTING FILMS AND VIDEOS

CROSS-REFERENCE TO A RELATED APPLICATION

This application is a National Phase patent application of International Patent Application Number PCT/DE2006/000813, filed on May 11, 2006, which claims priority of German Patent Application Number 10 2005 022 832.1, filed on May 11, 2005.

BACKGROUND

The invention relates to a spotlight for shooting films and videos with light-emitting diodes arranged on a light-emitting surface, and to a method for setting the color characteristics emitted by the spotlight.

Lighting spotlights with light-emitting diodes (LEDs) are known which are used for example as camera attachment light for film and video cameras. Since the LEDs used therefor have either the color temperature "daylight white" or "warm white", a continuously variable or exact switching on or switching over from a warm-white to a daylight-white color temperature is not possible and the color rendering when shooting films and videos is unsatisfactory in both variants.

Typical film materials for shooting films such as "cinema color negative film", are optimized for daylight with a color temperature of 5600 K or for incandescent lamp light with a color temperature of 3200 K and achieve excellent color rendering properties with these light sources for illuminating a set. If, when shooting films, other artificial light sources are used for illuminating a set, then these must be adapted to the optimum color temperature of 3200 K or 5600 K, on the one hand, and have a very good color rendering quality, on the other hand. In general, the best color rendering level with a color rendering index of CRI≧90 . . . 100 is required therefor.

As when use is made of fluorescent lamps for illumination when shooting films or videos, however, it can happen in the case of artificial light sources having a non-continuous spectral profile that although said light sources achieve the required values for color temperature and color rendering, when used for shooting films they nevertheless have a considerable color cast by comparison with light from incandescent lamps or HMI lamps or daylight. In this case, this is referred to as an inadequate mixed light capability. This effect can also occur when use is made of different-colored LEDs in an LED spotlight. Thus, in a test with an LED combination optimized for a color temperature of 5600 K and a color rendering index of CRI=96, when shooting films, a considerable red cast was ascertained in comparison with HMI lamps. Experiments with daylight-white LEDs also did not yield satisfactory results with regard to the mixed light capability.

DE 102 33 050 A1 discloses an LED-based light source for generating white light which makes use of the principle of three-color mixing. The three primary colors red green blue (RGB) are mixed in order to generate the white light, in which case at least one blue-light-emitting LED, which is referred to as transmission LED and emits directly used light primarily in the wavelength range of from 470 to 490 nm, and also another LED, which operates with conversion and is correspondingly referred to as conversion LED and emits light primarily in the wavelength range of at most 465 nm, are combined in a housing. Disposed in front of both LEDs or a surface (array) constructed from a multiplicity of both types of LEDs is a common conversion surface composed of a potting or a glass plate with one or more luminescent materials, such that the luminescent materials completely convert the light from the conversion LED but allow the light from the transmission LED to pass through unimpeded.

Optimum color rendering for shooting films and videos cannot be ensured with this light source either, since there is in particular the risk of overemphasis of suppression of color components and thus corruption of the colors of an object illuminated by the light source. For this reason, a light source of this type is used predominantly in the entertainment sector.

Moreover, the luminescent material in the known light source is excited by short-wave radiation of max. 465 nm, whereby disadvantages with regard to efficiency and lifetime of the luminescent LEDs are to be expected.

US 2004/0105261 A1 discloses a method and a device for emitting and modulating light with a predetermined light spectrum. The known lighting device has a plurality of groups of light-emitting devices, each group of which emits a predetermined light spectrum, and a control device controls the power supply to the individual light-emitting devices in such a way that the radiation that results overall has the predetermined light spectrum. In this case, through a combination of daylight-white and warm-white LEDs and changing the intensities, it is possible to set any color temperatures between the warm-white and daylight-white LEDs.

Disadvantages of these methods include the likewise non-optimum color rendering when shooting films and videos and the lack of an opportunity to set a predetermined color temperature and an exact color locus. Depending on the choice of individual LEDs or groups of LEDs and the color temperature respectively set, it is necessary here to reckon with in part considerable color deviations from the Planckian locus, which color deviations can only be corrected by placing correction filters in front. What is more, the luminous efficiency is not optimal in the case of a warm-white setting of the combination of daylight-white and warm-white LEDs, since relatively high conversion losses occur in this case as a result of the secondary emission of the luminescent material. A further disadvantage of this method is that, for setting a warm- or daylight-white color temperature, a large proportion of the LEDs of the respective other color temperature cannot be utilized or can only be utilized in greatly dimmed fashion and, consequently, the degree of utilization for the color temperatures around 3200 K or 5600 K that are typically required when shooting films is only approximately 50%.

SUMMARY

It is an object of the present invention to provide a spotlight for shooting films and videos with light-emitting diodes arranged on a light-emitting surface which ensures a very good color rendering and a homogeneous color mixture of the radiation emitted by different-colored LEDs, the color properties of which are optimized both for shooting films and for shooting videos and does not permit a color cast in comparison with recordings shot using other light sources, such as halogen incandescent lamps or daylight, and enables any desired setting of the color temperature or of a color locus in conjunction with very good utilization of the LEDs used.

This object is achieved by means of a spotlight of the type mentioned in the introduction whose light-emitting surface has at least three LEDs which emit different LED colors and provide luminous flux portions for a color mixture, at least one LED of which comprises a luminescent LED, and also with a device for setting the luminous flux portion emitted by the LEDs per color, said device driving the LEDs at least in groups.

The solution according to the invention provides an LED spotlight for shooting films and videos in which a very good color rendering is achieved through a suitable combination of different-colored LEDs and the color properties of which are optimized both for shooting films and for shooting videos without a color cast occurring in comparison with recordings shot using other light sources, such as halogen incandescent lamps or daylight. In this case, the assembly and arrangement of the LEDs enables a maximally homogeneous color mixture of the radiation emitted by the different-colored LEDs and, through exact driving of the different LED colors or groups of LED colors, the color temperature can be changed over or set as desired between approximately 2500 K and 7000 K or a color locus deviating from the Planckian locus can be set as desired within the gamut of the LEDs used. When a warm-white or daylight-white color temperature of 3200 K or 5600 K is set, a very high degree of utilization of ≧85% is achieved relative to the total luminous flux of the LEDs used.

The solution according to the invention was based on the insight that optimizing an artificial light source only for the color temperature and the color rendering index is insufficient for high-quality illumination for shooting films. It must additionally be ensured that the spectral distribution with regard to the spectral sensitivity of the film materials used does not lead to any undesired color casts in comparison with incandescent lamps or HMI lamps. It is thus necessary inter alia to avoid or skillfully compensate for a correspondence of the maxima of the film sensitivity curves with spectral emission peaks of the light source.

The solution according to the invention is based on the consideration of using at least three different-colored LEDs for an LED spotlight suitable especially for shooting films and videos, of which LEDs one LED is embodied as a luminescent LED and emits either a white, in particular daylight-, neutral- or warm-white color or a yellow and/or green color. A luminescent LED that emits a yellow and/or green color is also called "yellow-green luminescent LED" hereinafter and is preferably combined with at least one LED that emits the LED color "blue".

The solutions described below demonstrate suitable LED combinations with which it is possible to ensure, in conjunction with appropriate color temperature and excellent color rendering, at the same time a full mixed light capability in the case of a use for shooting films and videos.

This gives rise to the combination of a white luminescent LED or a yellow-green luminescent LED with at least three monochrome LEDs, at least one monochrome LED of which has the LED color "blue" when a yellow-green or warm-white luminescent LED is used.

In one exemplary embodiment the combinations of a plurality of monochrome LEDs and a white luminescent LED or a yellow-green luminescent LED are combined to form an LED module and the light-emitting surface of the spotlight is assembled from an array of LED modules.

One possibility for miniaturizing and improving the color homogeneity of the individual LED modules consists in at least partly eliminating the spatial separation of luminescent LEDs and color LEDs. Accordingly, according to a further feature of the invention, the luminescent material layer of the luminescent LED covers not only the luminescent LED but furthermore those chips of the color LEDs of the green to red wavelength range which adjoin the chip of the luminescent LED. In this case, the chip of the luminescent LED is arranged for example in the center of an LED module. The luminescent material layer covers a larger area in comparison with the size of the luminescent LED.

However, it is preferred for the blue color LED not to be integrated under the luminescent material layer of the yellow-green or white luminescent LED. The blue color LED is excluded from this integration since its radiation would otherwise excite the luminescent material of the yellow-green or white luminescent LED to effect secondary emissions, such that the radiation of the blue color LED could no longer be set independently of the radiation of the yellow-green or white luminescent LED.

By contrast, the radiation of the green to red color LEDs does not excite the yellow-green luminescent material of the yellow-green or white luminescent LED and cannot pass through it without a spectral change.

This configuration of the exemplary solution according to the invention makes it possible, on the one hand, to accommodate the chips in a very confined space since the chips of the color LEDs can be positioned very close to the chip of the luminescent LED. On the other hand, however, what is achieved by means of the miniaturization and the associated higher luminance of the individual LED modules is that a better quality of the beam shaping and color homogenization is achieved by the optical elements downstream of the radiation source.

A further advantage is that part of the radiation emitted by the color LEDs is scattered by the luminescent material layer of the luminescent LEDs and, consequently, the entire surface of the luminescent material layer lights up in the colors of the color LEDs, whereby the homogenization of the color mixture is additionally improved.

When the color LEDs and the luminescent LEDs are combined to form an LED module, each LED color, for example yellow-green, blue or red, comprises one or a plurality of LED chips in order to provide the optimum luminescent flux portions for the color mixture. The number of LED chips actually used in each LED module or in the array of LED modules for the light-emitting surface of the spotlight per color is oriented to the power and luminous efficiency of the monochrome LEDs and luminescent LEDs used. Since this can change over the course of time due to the development of new LEDs, the number of LEDs required for each color is selected in such a way that the brightness conditions presented below are established in conjunction with full luminous flux emission, while by reducing the partial luminous flux in particular by dimming individual color LEDs with a minimum of required LEDs it is possible to set the relevant color temperature range of approximately 2700 K to 6000 K with optimum color rendering and at the same virtually constant brightness.

In a further exemplary configuration of the solution according to the invention, a homogeneous color mixture of the different LEDs is achieved by virtue of the fact that the different-colored LEDs are arranged spatially very closely in small modules by means of chip-on-board technology, in which case each module as smallest and complete unit contains all the required LED colors and the number of LEDs used per color is oriented to the chip size and the required partial luminous flux. Accordingly, by way of example, an LED module can contain a daylight-white, warm-white or yellow-green luminescent LED and also in each case four blue, green, amber-colored and red color LED chips.

In one exemplary configuration of the solution according to the invention, the LED modules have in each case at least five different LEDs, of which one LED is embodied as a yellow-green or white luminescent LED, one LED is embodied as a monochrome cyan-colored or blue color LED, one LED is embodied as a monochrome green color LED and two LEDs are embodied as different monochrome color LEDs with a red, orange, yellow-orange or yellow LED color.

In a first exemplary variant of the solution according to the invention, the LED modules have a yellow-green or white luminescent LED, a monochrome blue color LED having a peak wavelength of 430 nm-480 nm, preferably 450 nm-480 nm, a monochrome green color LED having a peak wavelength of 505 nm-535 nm, a monochrome amber-colored color LED having a peak wavelength of 610 nm-640 nm, and a monochrome red color LED having a peak wavelength of 630 nm-660 nm.

In a second exemplary variant of the solution according to the invention, the LED modules have a yellow-green or white luminescent LED, a monochrome cyan-colored color LED having a peak wavelength of 430 nm-515 nm, preferably 485 nm-515 nm, a monochrome green color LED having a peak wavelength of 505 nm-535 nm, a monochrome yellow color LED having a peak wavelength of 580 nm-610 nm, and a monochrome amber-colored color LED having a peak wavelength of 610 nm-640 nm.

In a third exemplary variant of the solution according to the invention, the LED modules have a yellow-green or white luminescent LED, a monochrome cyan-colored color LED having a peak wavelength of 480 nm-515 nm, preferably 485 nm-515 nm, a monochrome green color LED having a peak wavelength of 505 nm-535 nm, a monochrome yellow color LED having a peak wavelength of 580 nm-610 nm, a monochrome amber-colored color LED having a peak wavelength of 610 nm-640 nm, and a monochrome blue color LED having a peak wavelength of 430-480 nm, preferably 450 nm-480 nm.

In a fourth exemplary variant of the solution according to the invention, the LED modules have a yellow-green or white luminescent LED, a monochrome cyan-colored color LED having a peak wavelength of 480 nm-515 nm, preferably 485 nm-515 nm, a monochrome green color LED having a peak wavelength of 505 nm-535 nm, a monochrome yellow color LED having a peak wavelength of 580 nm-610 nm, and a monochrome red color LED having a peak wavelength of 630 nm-660 nm.

In a fifth exemplary variant of the solution according to the invention, the LED modules have a yellow-green or white luminescent LED, a monochrome cyan-colored color LED having a peak wavelength of 480 nm-515 nm, preferably 485 nm-515 nm, a monochrome green color LED having a peak wavelength of 505 nm-535 nm, a monochrome yellow color LED having a peak wavelength of 580 nm-610 nm, a monochrome red color LED having a peak wavelength of 630 nm-660 nm, and a monochrome blue color LED having a peak wavelength of 430 nm-480 nm, preferably 450 nm-480 nm.

In a sixth exemplary variant of the solution according to the invention, the LED modules have a yellow-green or white luminescent LED, a monochrome cyan-colored color LED having a peak wavelength of 480 nm-515 nm, preferably 485 nm-515 nm, a monochrome green color LED having a peak wavelength of 505 nm-535 nm, a monochrome amber-colored color LED having a peak wavelength of 610 nm-640 nm, and a monochrome red color LED having a peak wavelength of 630 nm-660 nm.

In a seventh exemplary variant of the solution according to the invention, the LED modules have a yellow-green or white luminescent LED, a monochrome cyan-colored color LED having a peak wavelength of 480 nm-515 nm, preferably 485 nm-515 nm, a monochrome green color LED having a peak wavelength of 505 nm-535 nm, a monochrome amber-colored color LED having a peak wavelength of 610 nm-640 nm, a monochrome red color LED having a peak wavelength of 630 nm-660 nm, and a monochrome blue color LED having a peak wavelength of 430 nm-480 nm, preferably 450 nm-480 nm.

In an eighth exemplary variant of the solution according to the invention, the LED modules have a yellow-green or white luminescent LED, a monochrome blue color LED having a peak wavelength of 430 nm-480 nm, preferably 450 nm-480 nm, a monochrome green color LED having a peak wavelength of 505 nm-535 nm, a monochrome yellow color LED having a peak wavelength of 580 nm-610 nm, and a monochrome red color LED having a peak wavelength of 630 nm-660 nm.

In a ninth exemplary variant of the solution according to the invention, the LED modules have in each case fewer than five different LEDs, namely a yellow-green or white luminescent LED, a monochrome blue color LED having a peak wavelength of 430 nm-480 nm, preferably 450 nm-480 nm, a monochrome red color LED having a peak wavelength of 630 nm-660 nm. In this case, the blue color LED must never be arranged, and the red color LED can optionally be arranged, below the luminescent material layer of the luminescent LED.

In all the variants, it is possible, of course, for a plurality of color LEDs to be present for each color in an LED module. Moreover, a plurality of luminescent LEDs can be present in an LED module.

For setting the optimum color characteristics for shooting films and videos, the luminous flux portion emitted by the individual color LEDs of an LED module is determined and the radiation intensity of the LEDs is tracked continuously or at intervals in order to compensate for changing ambient conditions and aging effects of the modules. A control or regulating device provided for this purpose contains at least one measuring device which is arranged between the LED board and the front side of the spotlight, is preferably regulated to a constant temperature, detects the radiation intensity of the LEDs and is embodied as a calorimeter, RGB sensor, V(λ) sensor or light sensor. In this connection it may also be conceivable and advantageous to use an external measuring device arranged outside the region between LED board and the front side of the spotlight.

In one exemplary advantageous configuration, the measuring device is formed by at least five light sensors having different spectral sensitivities in the visible wavelength range between 380 nm and 780 nm. In this case, the at least five light sensors can be optimized in terms of their spectral sensitivity in narrowband fashion to the radiation emitted by the LEDs by means of optical filters, e.g. dichroic filters, and can be oriented in terms of their spectral sensitivity to the maxima of the monochrome LEDs for the determination of the radiation components of the monochrome LEDs, the spectral sensitivity of the light sensor for determining the radiation component of the white or the yellow-green luminescent LED having its maximum either in the range of 530 . . . 610 nm or else in the range of 650 . . . 750 nm. In the case of an LED combination without monochrome blue LEDs, the maximum of the spectral sensitivity of the light sensor for determining the radiation component of the white or the yellow-green luminescent LED can alternatively lie in the wavelength range of 430 . . . 490 nm. An advantage of this arrangement is that the luminous flux portions of all the LED colors involved can be determined directly and simultaneously from the signals of the sensors and, if necessary, the intensity of the LEDs can be corrected in order e.g. to track thermally dictated brightness or color changes. In the case of deviations with respect to the predetermined target color locus, the color locus can then be readjusted immediately, continuously and without any disturbance for the user or for the camera. A warning to the user can therefore be obviated, and it is not necessary to determine the luminous flux portions in a separate work step.

In one exemplary embodiment of the invention, a representative portion of each LED color is coupled into the light-sensitive surface of the measuring device, in which case in particular a light guiding plate fitted in front of an array of e.g. side-emitting LEDs mixes and homogenizes the light and permits it to emerge upward uniformly. A representative portion of each LED color is coupled into the measuring device through a small opening in outwardly peripheral reflective coating of the light guiding plate.

In an alternative exemplary embodiment, a monitor LED module arranged at a thermally representative location of the array of LED modules is used for illuminating the measuring receiver and part of the radiation emitted by the LEDs by means of an optical waveguide is coupled into the measuring device.

In a further exemplary alternative embodiment, a monitor LED module likewise arranged at a thermally representative location of the array of LED modules is used for indirectly illuminating the measuring receiver. In this case, the monitor LED module illuminates a diffuser lamina which is fitted above the monitor LED module and which is reflectively coated toward the top in order to eliminate incident ambient light for the measurement. The sensor is situated directly alongside the monitor LED module and detects the light reflected by the diffuser lamina. In order to avoid the detection of ambient light incident laterally on the sensor, the sensor can either be accommodated in an e.g. ring-shaped tube whose aperture is coordinated with the size and distance of the diffuser lamina. Alternatively, the diffuser lamina is situated together with the sensor within a measuring capsule placed above the monitor LED module, said capsule preferably being light-tight and inwardly white or reflectively coated.

Furthermore, the spectral sensitivity of color sensors used in the measuring device can be adapted by means of interference filters, wherein the aperture of the color sensors should typically be limited to a small aperture of less than 10° in order to minimize chromatic aberrations as a result of obliquely incident light.

The measurement of the individual LED colors can be initiated manually and an optical and/or acoustic signal device can indicate the deviation of the present setting from a predetermined desired value.

Preferably, the desired color temperature, the desired color locus, a color correction which emulates color correction filters placed in front, and/or a light color which emulates color filters or a light source, are input by means of a user interface.

In a further exemplary advantageous configuration, the spotlight is designed in such a way that the color temperature is automatically adapted and tracked depending on the brightness of the spotlight in a dimming mode. By way of example, the dimming of an incandescent lamp, the color temperature of which changes with the brightness, can thus be simulated by virtue of the fact that when the brightness of the spotlight changes, the color temperature is simultaneously also adapted, such that a brightness-color temperature profile corresponding to the dimming characteristic of an incandescent lamp is obtained.

It is furthermore conceivable and advantageous to design the spotlight in such a way that any desired light source and/or light color selected by a user can be set. In this case, the light source to be simulated may be a fluorescent lamp, in particular. By way of example, the light color 842 of a fluorescent lamp with a color temperature of 4200 K and a color rendering index CRI of greater than 80 can then be predetermined by a user and can be simulated by the spotlight in such a way that color casts are minimized when shooting films and videos. This may be expedient particularly when the spotlight is used for recordings in buildings equipped with fluorescent lamps, for example as reporting light, and facilitates handlability and operability of the spotlight for a user.

In order to obtain optimum color characteristics for shooting films and videos on a spotlight having the features mentioned above, the luminous flux portion emitted by the individual LEDs of an LED module is set by means of the following method steps.

A method for setting the optimum color characteristics emitted by a spotlight is distinguished by the fact that after the spotlight has been switched on, the maximum available radiation components of the LED colors are measured and during the operation of the spotlight from time to time the present RGB or intensity values of the LED colors are measured, and the radiation intensity of the LED colors is readjusted taking account of the present RGB or intensity values determined for each LED color in order to compensate for temperature and aging effects.

Preferably, in this case, the present color locus is calculated from the present RGB or intensity values of the total radiation of the LED colors (R, G, A, B, Ye) and, in the event of deviations from the target color locus, the present RGB or intensity values of the individual LED colors (R, G, A, B, Ye) are measured. Whereupon the radiation intensity of the LED colors (R, G, A, B, Ye) is readjusted taking account of the present RGB or intensity values determined for each LED color (R, G, A, B, Ye).

The measurement of the present RGB or intensity values of the LED colors during operation can be effected, in a first exemplary alternative, by virtue of the fact that the individual LED colors are activated successively one shortly after another and the RGB or intensity values are measured.

In a second exemplary alternative, two or at most three LED colors are successively activated and measured jointly, the intensities of the individual LED colors being calculated from the measured RGB value.

In a third exemplary alternative, firstly to the total radiation is measured and then each individual LED color is switched off in turn and the RGB or intensity value of the remaining LED colors is measured and the RGB or intensity values of the LED color respectively switched off are determined by subtraction.

In configurations in which the radiation of a monitor LED module is detected by a measuring device assigned to said module, the initiation of the measurement and subsequent regulation of the LED intensity conditions can also be effected at fixed, short intervals if, for this purpose, exclusively the LED colors of the monitor LED module are briefly switched on and off and the contribution of the monitor LED module to the total brightness is less than 1%. In this case, no disturbing brightness of color fluctuations occur in the course of shooting films or videos as a result of the measuring and regulating cycles.

In a fourth exemplary alternative, finally, the radiation components of the LED colors are determined by measuring the total radiation of all the LED colors using light sensors having different spectral sensitivities. A prerequisite for this is that the number of light sensors corresponds to the number of LED colors used. An advantage of this variant is that an additional work step, disturbing illumination operation, is not required for detecting the radiation components, rather the radiation components can be determined continuously during the operation of the spotlight.

BRIEF DESCRIPTION OF THE DRAWINGS

The basic structure of the LED spotlight according to the invention, the setting of the color characteristics and color temperatures and also the control of the color intensities during the operation of the LED spotlight will be explained in more detail on the basis of exemplary embodiments illustrated in the figures, in which.

DETAILED DESCRIPTION

Figure 1:
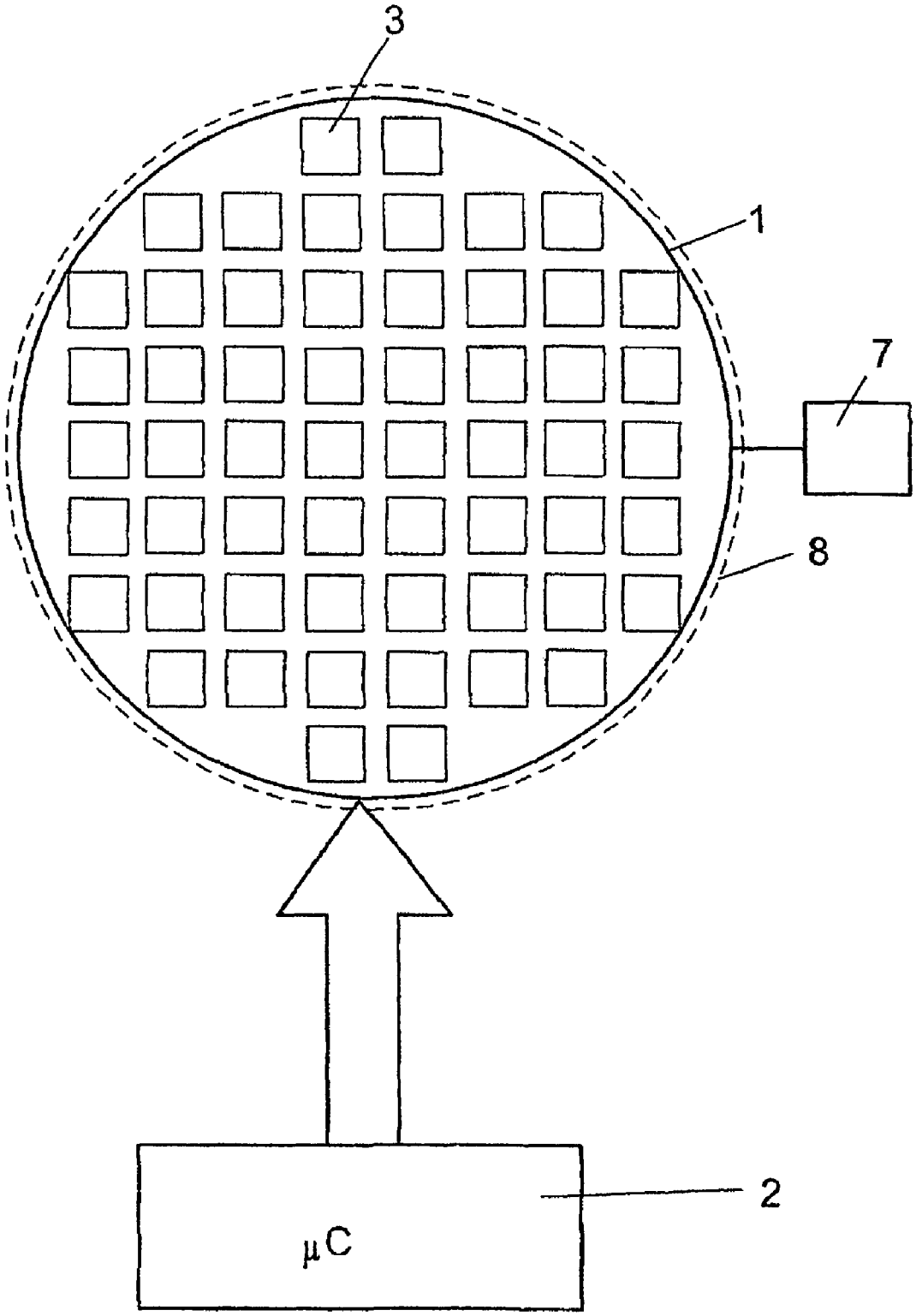
FIG. 1 shows a schematic view of a light-emitting surface of a spotlight with measuring device, said surface being composed of an array of controllable LED modules.

FIG. 1 shows a schematic plan view of the light-emitting surface or LED board 1 of a spotlight, which contains an array of LED modules 3 in rows and columns connected individually or in groups to a control device 2, which for example varies the electrical power fed to the individual LED modules 3 or groups of LED modules. This can be done by varying the current fed to the LED modules by means of a pulse width modulation (frequency>10 kHz in order to avoid exposure fluctuations when shooting at high speed) or by altering the DC current intensity by means of changing resistances or the like.

Figure 9B:
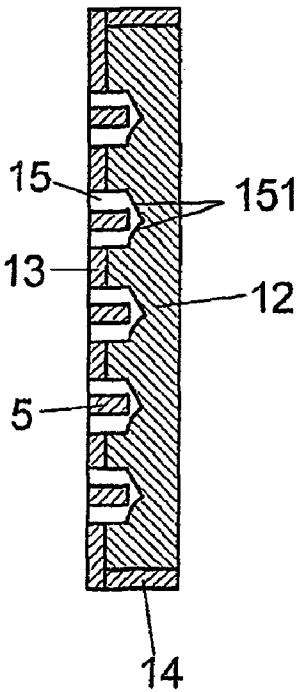
FIG. 9B shows a section through the LED spotlight from FIG. 9*a* along the line A-B.
Figure 9A:
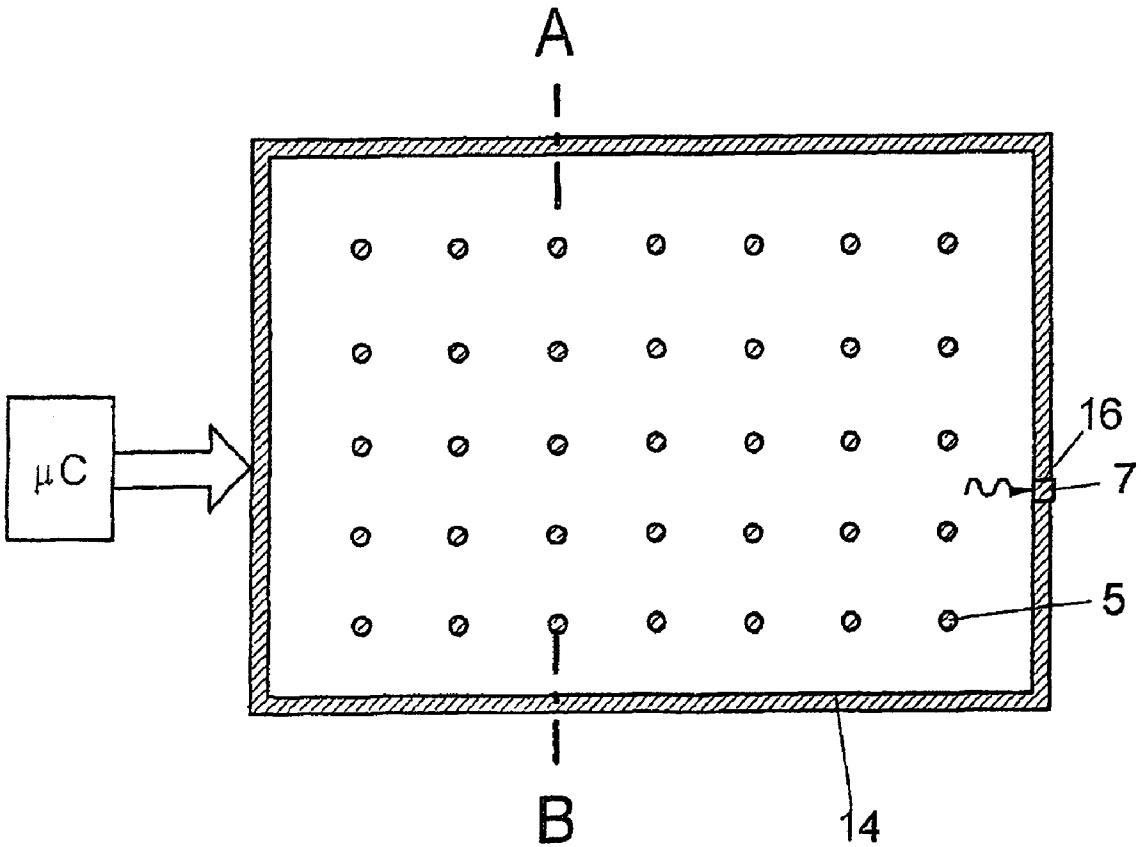
FIG. 9A shows a section through an LED spotlight with a measuring device, in which light emitted by side-emitting LEDs is mixed by means of a light guiding plate.

In order to detect the luminous flux portion emitted by the LED modules 3, a measuring device 7 with a light-sensitive surface is provided, into which a representative portion of each LED color is coupled. For this purpose, the measuring device 7 is connected for example via a thin optical waveguide to a white diffuser lamina which is reflectively coated toward the top and which is arranged above a monitor LED module at a thermally representative location of the LED modules. The diffuser lamina receives radiation of each LED color and couples it into the optical waveguide. A schematic section through a corresponding arrangement of an optical waveguide 8 or alternative arrangements of the sensor without the use of an optical waveguide is illustrated in FIGS. 9*a*, 9*b* and also FIGS. 17*a* to 21*b*.

The total color emitted from the LED modules 3 is measured either continuously or at predetermined time intervals in order to continuously take account of a change in ambient parameters such as the ambient temperature and aging-dictated changes in the LED modules 3. If deviations from the desired color locus set are ascertained in the process, then it is possible here either at predetermined time intervals or in a manner initiated manually, for the individual intensities of the LED colors of the LED modules to be measured and for the color to be readjusted.

Figure 2:
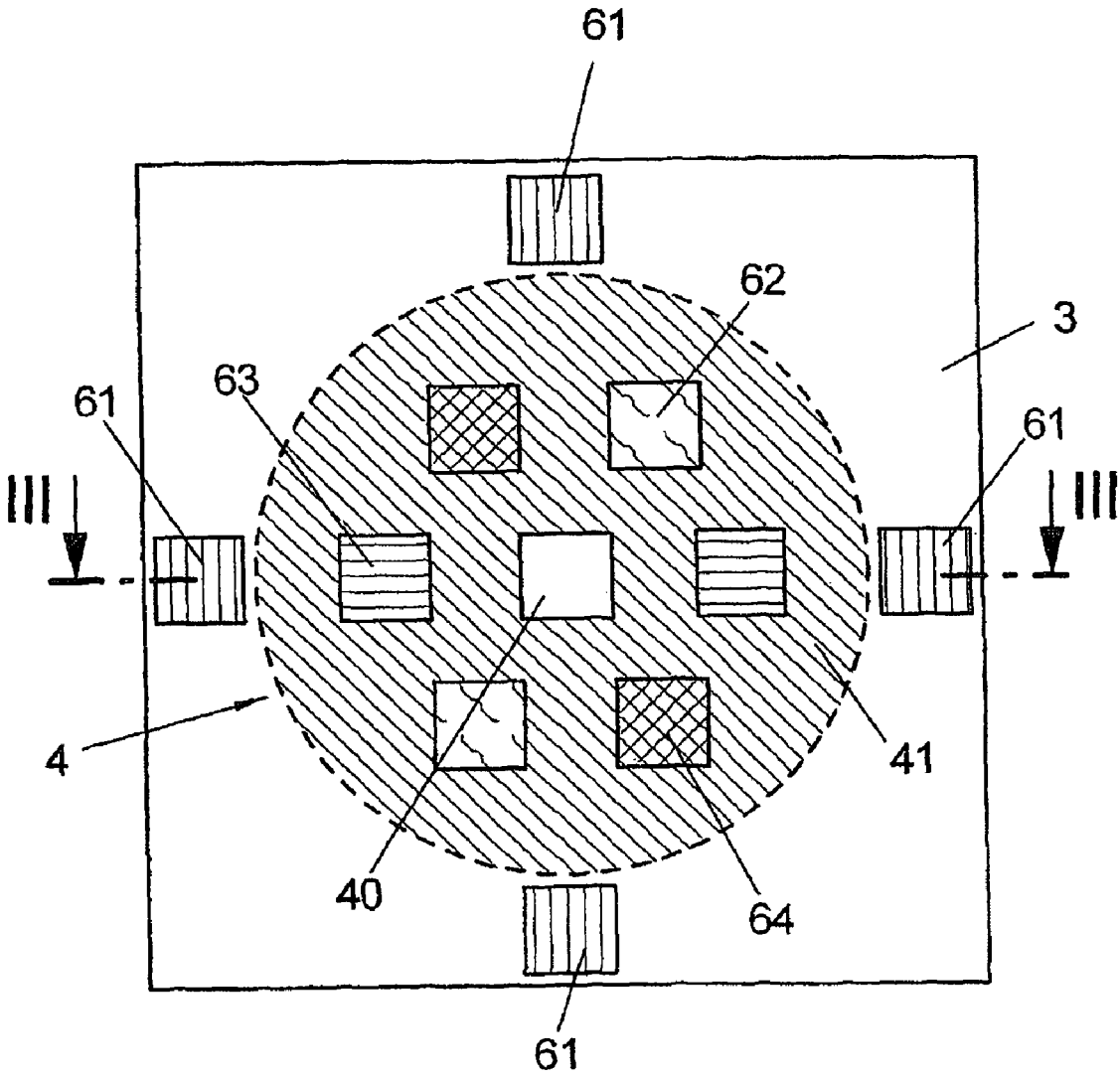
FIG. 2 shows a schematic plan view of an LED module with a yellow-green or white luminescent LED, the luminescent material layer of which covers a plurality of color LEDs.
Figure 3:
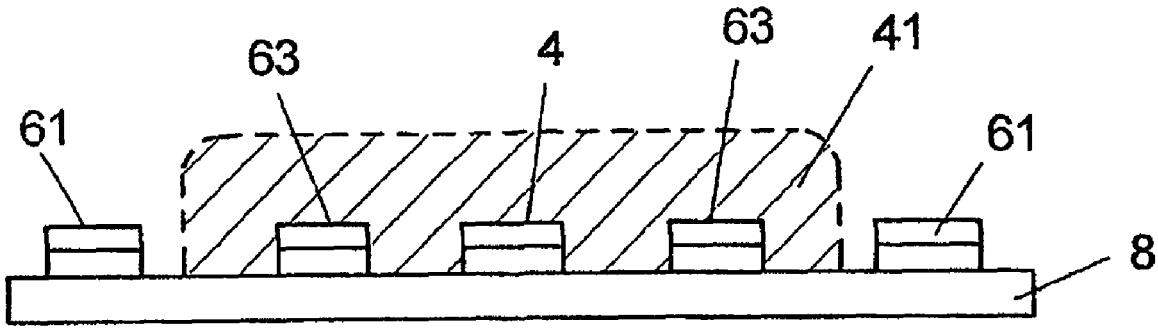
FIG. 3 shows a section through the LED module in accordance with FIG. 2 along the line III-III.
Figure 4:
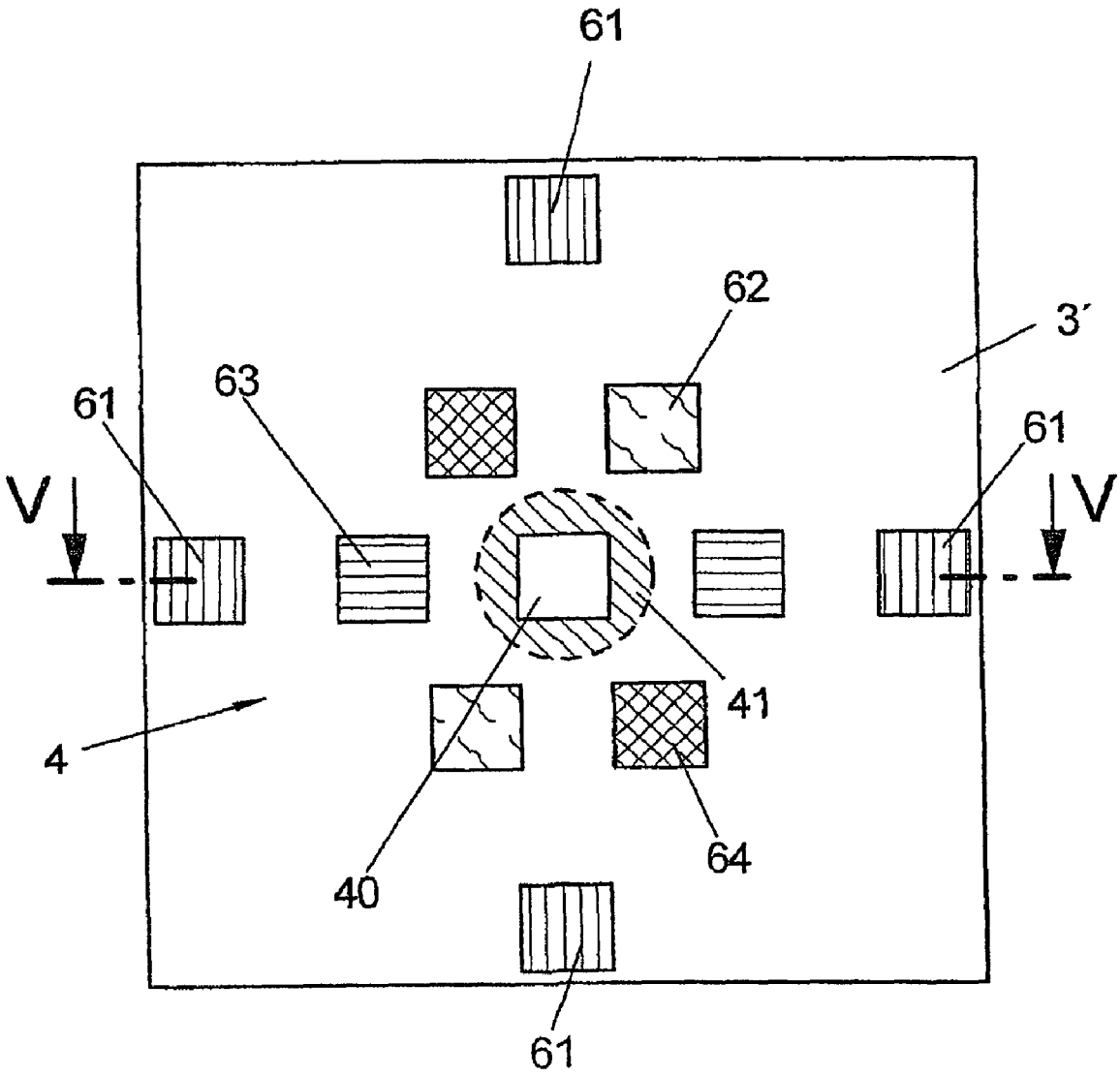
FIG. 4 shows a schematic plan view of an LED module with a yellow-green or white luminescent LED, the luminescent material layer of which is limited to the luminescent LED and does not cover adjoining color LEDs.
Figure 5:
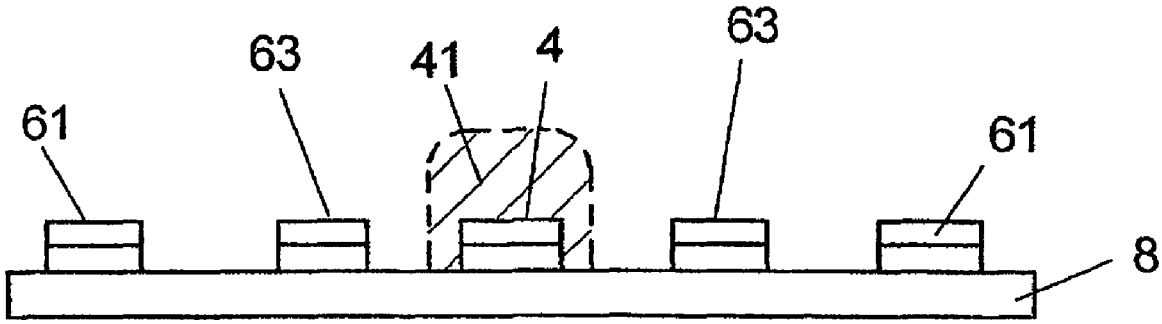
FIG. 5 shows a section through the LED module in accordance with FIG. 4 along the line V-V.

FIGS. 2 and 4 illustrate a schematic plan view of different LED modules 3 and 3', and FIGS. 3 and 5 illustrate a section through the LED modules 3 and 3' in accordance with FIGS. 2 and 4 along the line III-III and V-V, respectively.

The LED module 3 illustrated in a schematic plan view in FIG. 2 contains centrally a chip 40 of a yellow-green or white luminescent LED 4, around which a plurality of color LEDs 61 to 64 are arranged, of which six color LEDs 62 to 64 of the wavelengths green to red are grouped around the chip 40 of the yellow-green or white luminescent LED 4. In this case they can, but need not, adjoin the chip 40 directly. The luminescent material layer 41 of the yellow-green or white luminescent LED 4 covers both the chip 40 of the yellow-green or white luminescent LED 4 and the color LEDs 62 to 64. Further, exclusively blue or cyan-colored color LEDs 61 are arranged outside the luminescent material layer 41, such that their radiation cannot excite the luminescent material layer 41 to effect secondary emissions and the radiation of the blue or cyan-colored color LED 61 can thus be set independently of the radiation of the luminescent LED 4 and the radiation of the colored LEDs 62 to 64.

The following is noted with regard to the functioning. The luminescent LED 4 comprises a blue LED chip 40 covered by the luminescent material layer 41. The blue radiation emitted by the LED chip 40 excites the luminescent material to effect longer-wave (e.g. yellow-green) secondary emission. The total color of the luminescent LED 4 is the mixed color of the blue light component, which passes through the luminescent material unchanged, and also the color of the light converted into longer-wave radiation. The color locus (standard chromaticity coordinates x, y) of the light emitted by the luminescent LED 4 can be varied depending on the choice of luminescent material and the layer thickness thereof and, in the standard chromaticity diagram, is situated on the connecting straight line between the two color loci of the blue primary radiation and the secondary radiation of the luminescent material.

By way of example, phosphor or a phosphor mixture with a yellow or yellow-green coloration can be used as luminescent material. In this case, the color locus and the color temperature of the luminescent LED 4 can vary, depending on the layer thickness of the phosphor or phosphor mixture applied as luminescent material layer 41, from yellow, yellow-green, warm-white through neutral-white to daylight-white with a color temperature of 50 000 K.

Depending on the luminescent material layer applied, therefore, a luminescent LED 4 with a color locus and a color temperature between yellow and daylight-white can be produced and can be used for the spotlight. Such a luminescent LED is generally referred to herein as yellow-green or white luminescent LED 4.

The spectral radiation components of the light emitted by the green, yellow, amber-colored and/or red LEDs 62-64 lie above the excitation spectrum of the luminescent material and for this reason were not absorbed by the luminescent material and converted into longer-wave radiation. Consequently, the radiation of these LEDs is not altered spectrally by the luminescent material. Only in the case of green LEDs is a small portion of the short-wave spectrum converted into longer-wave (yellow-green), radiation by the luminescent material. Since the converted portion lies favorably with respect to the spectral photopic luminosity curve of the human eye, this effect slightly increases the luminous efficiency of the green LEDs, where no adverse effects whatsoever, such as impairment of the color rendering, occur. Green color LEDs can therefore likewise be arranged under the luminescent material layer.

Consequently, although the color LEDs 62-64 are situated below the luminescent material layer, on account of their quasi unchanged, narrowband LED spectrum they are not luminescent LEDs, but rather color LEDs.

By contrast, in terms of its spectral composition the radiation emitted by the blue or cyan-colored LEDs 61 still falls within the excitation spectrum of yellow-green luminescent materials. Therefore, said color LEDs cannot be concomitantly arranged below the luminescent material layer since their radiation would be spectrally altered to an excessively great extent by the luminescent material. Depending on the spatial arrangement of the blue or cyan-colored chips 61, a negligible luminous flux portion emerging laterally from the chip may possibly impinge on the luminescent material layer and be converted into longer-wave, yellow-green radiation (cf. FIG. 6). For the same reasons as for the green LED, however, this effect is not associated with any disadvantages whatsoever for the efficiency or color quality of the total radiation.

In an alternative embodiment of the module 3' in accordance with FIGS. 4 and 5, the chip 40 of a yellow-green or white luminescent LED 4 is likewise arranged centrally and surrounded by a plurality of color LEDs 61-64. In this case, in the same way as the blue or cyan-colored LEDs 61, the further color LEDs 62-64, too, are not covered by the luminescent material layer 41 of the luminescent LED; said layer extends solely over the chip 40. In order to bring about a precollimation of the light emitted by the LEDs, the individual LEDs can be embedded in microreflectors, also called "cups" or "cavities", which are preferably silvered in order to minimize light losses through absorption.

The use of four different-colored color LEDs 61-64 in FIGS. 2 and 4 should be understood only by way of example; it is also possible to use a different number of different LEDs and/or the latter can be arranged in a different way. In this case, one preferred embodiment provides for arranging four blue color LEDs, four green color LEDs, two amber-colored color LEDs and six red color LEDs around a central luminescent LED having an edge length of 1 mm, for example. In this case, the green, amber-colored and red color LEDs are distributed as uniformly as possible around the central luminescent LED, for example by being arranged on two concentric circles around the luminescent LED. Other colors can also be used, although the blue or cyan-colored LED 61 is always arranged outside the luminescent material layer of the luminescent LED.

Figure 6:
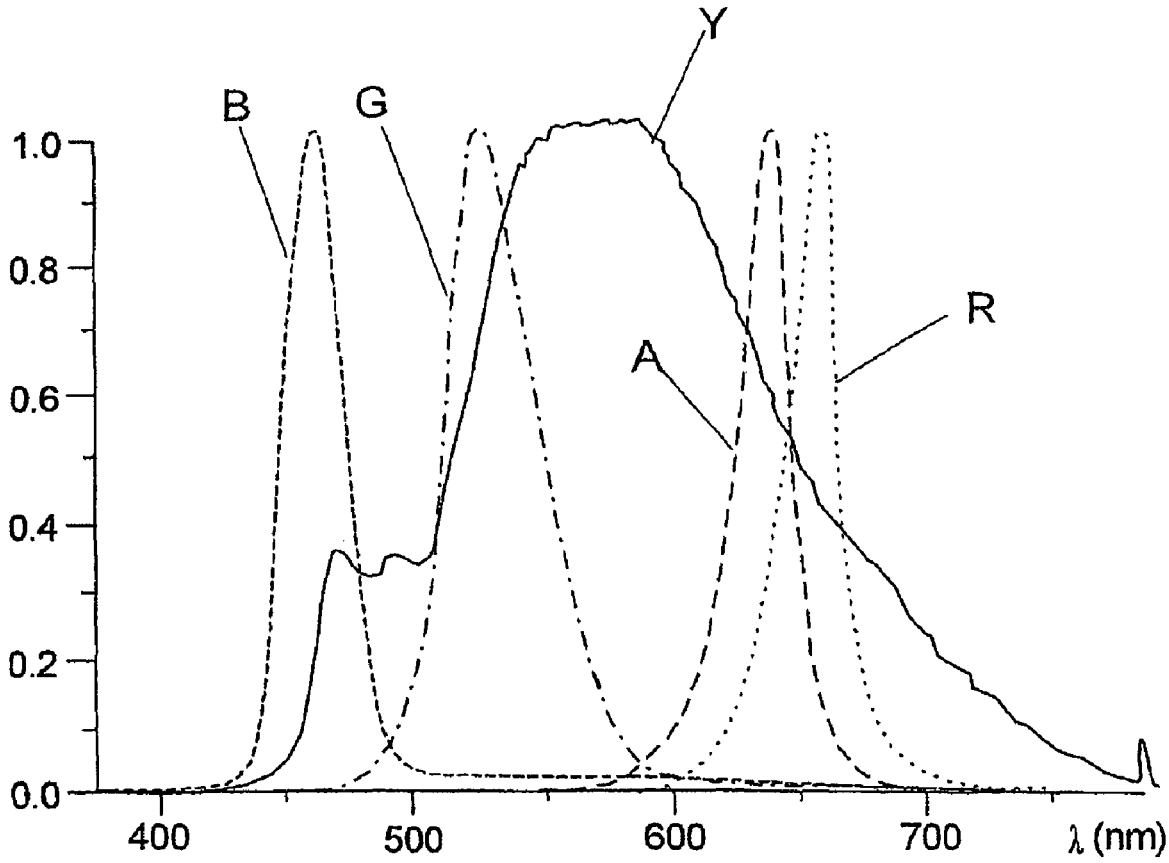
FIG. 6 shows the relative wavelength spectra for blue color LEDs, green color LEDs, amber-colored color LEDs and red color LEDs and also for yellow-green luminescent LEDs.
Figure 7:
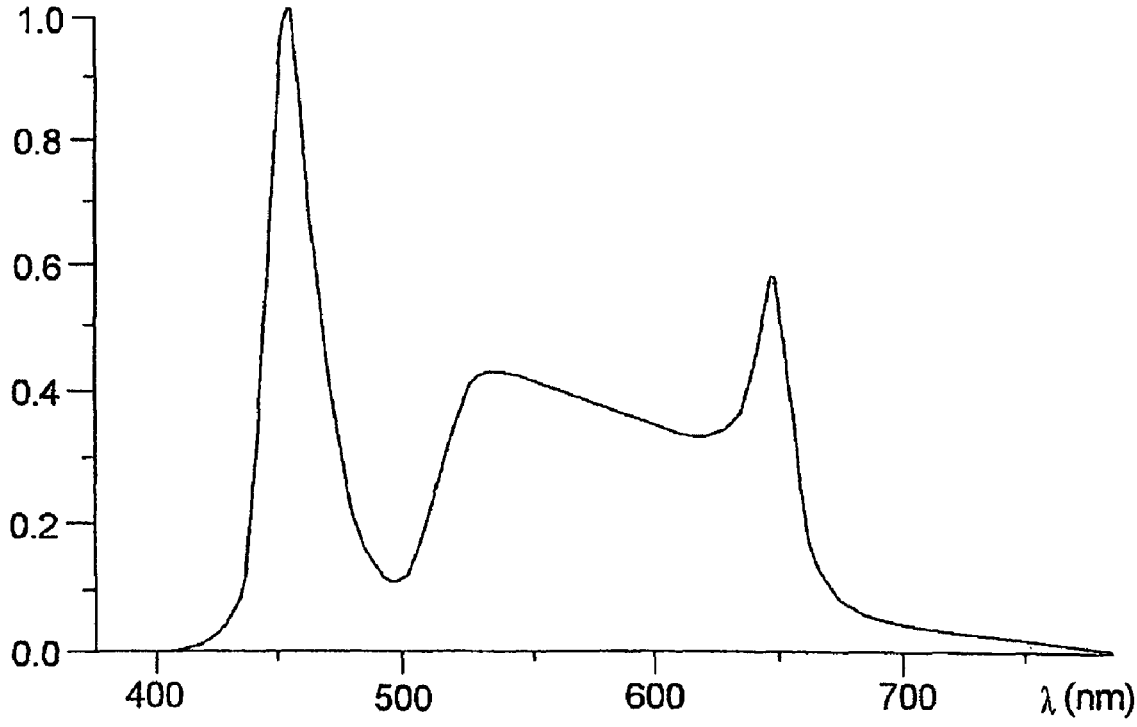
FIG. 7 shows a relative wavelength spectra of a first optimized LED combination for shooting films and videos with warm-white and daylight-white color temperatures.
Figure 8:
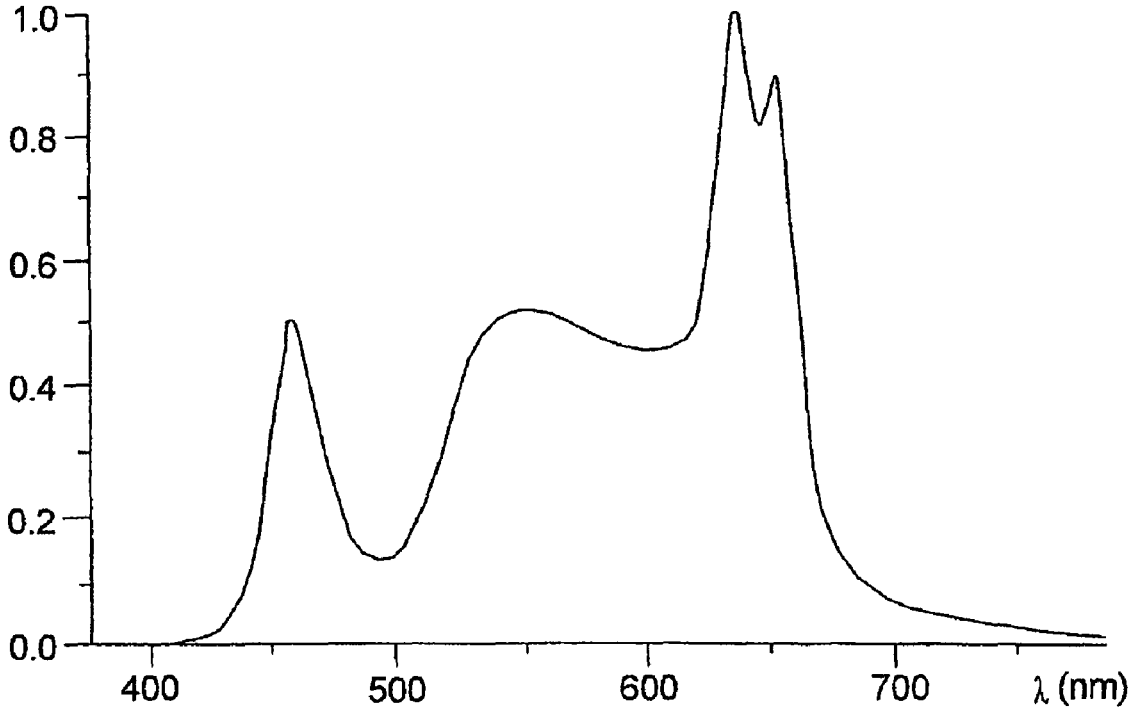
FIG. 8 shows a relative wavelength spectra of a second optimized LED combination for shooting films and videos with warm-white and daylight-white color temperatures.

FIG. 6 shows the wavelength spectra for blue color LEDs 61 (B), green color LEDs 62 (G), amber-colored color LEDs 63 (A) and red color LEDs 64 (R) and also for a yellow-green luminescent LED (Y) of an LED module, and FIGS. 7 and 8 show wavelength spectra for two optimized LED combinations in which, in conjunction with appropriate warm- or daylight-white color temperature of the total radiation and excellent color rendering, the full mixed light capability is ensured in the case of a use for shooting films and videos. In this case, it can be discerned from the spectrum of the blue LED that a small luminous flux portion is converted into longer-wave radiation by the adjacent luminescent material.

Two exemplary embodiments use the abovementioned LED colors in combination with a yellow-green luminescent LED, the peak wavelengths of which in accordance with FIG. 6 are at the following wavelengths λ:

| | Peak wavelength λ (nm) |
|---|---|
| Color LED | |
| Blue | 461 |
| Green | 522 |
| Amber | 631 |
| Red | 646 |
| Luminescent LED | |
| Yellow-green | 563 |

The two exemplary embodiments involve two LED combinations for the settings "tungsten" and "daylight", the optimized LED combinations containing the abovementioned LED colors blue, green, amber, red and a yellow-green luminescent LED.

An LED module optimized for shooting films and videos for the settings "tungsten" and "daylight" is composed of the following luminous flux portions of the above-specified LED colors and the peak wavelengths thereof. This LED combination ensures a high luminous flux utilization factor of ≧85% for the settings tungsten and daylight.

| LED color | Tungsten | Daylight |
|---|---|---|
| Blue | 3.4% | 10.5% |
| Green | 0.2% | 10.4% |
| Amber | 7.4% | 5.9% |
| Red | 4.1% | 0.0% |
| Yellow-green | 84.8% | 73.2% |
| Total | 100.0% | 100.0% |

This results in a color temperature of 5732 K in conjunction with a color rendering index CRI of 93 for the setting "daylight", the wavelength distribution of which is illustrated in FIG. 7, and a color temperature of 3215 K in conjunction with a color rendering index CRI of 96 for the setting "tungsten", the wavelength distribution of which is illustrated in FIG. 8.

From the color temperature, the color rendering index CRI, the spectral radiation distribution of the light source, the spectral sensitivity functions of color negative and color positive films sensitized to "tungsten" and "daylight", in conjunction with a xenon lamp as projection light source, an empirical assessment variable of the mixed light capability is determined, which identifies both exemplary embodiments as very suitable for shooting films and videos.

Figure 25:
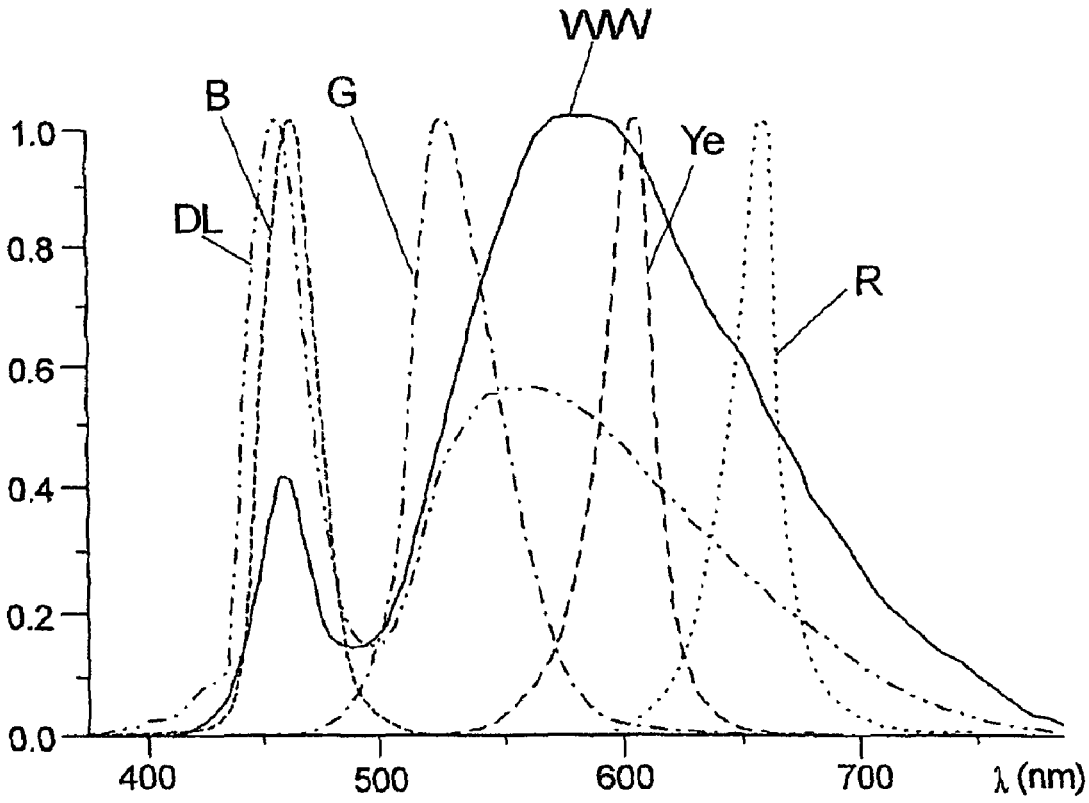
FIG. 25 shows the relative wavelength spectra for daylight-white and warm-white luminescent LEDs and also for blue, green, yellow and red color LEDs.

FIG. 25 shows the wavelength spectra for blue color LEDs 61 (B), green color LEDs 62 (G), yellow color LEDs (Ye) and red color LEDs 64 (R) of an LED module and also for a daylight-white luminescent LED 4 (DL) and a warm-white luminescent LED 4 (WW), which can be combined in one LED module in a further configuration, either a daylight-white or a warm-white luminescent LED being arranged together with the color LEDs in one LED module.

Four exemplary embodiments use the abovementioned LED colors in combination with a daylight-white (DL) luminescent LED and a warm-white (WW) luminescent LED, the peak wavelengths of which in accordance with FIG. 25 are at the following wavelengths λ (for the luminescent LEDs the color temperatures most similar in each case to the luminescent LEDs are specified instead of the peak wavelengths):

| Color LED | Peak wavelength λ (nm) |
|---|---|
| Blue | 461 |
| Green | 522 |
| Yellow | 594 |
| Red | 646 |
| **Luminescent LED** | **Most similar color temperature (kelvins)** |
| Daylight white | 5370 |
| Warm white | 3170 |

The exemplary embodiments described below concern two LED combinations for the settings "warm white" and "daylight", the optimized LED combinations containing the abovementioned LED colors blue, green, yellow, red and a daylight-white and, respectively, a warm-white luminescent LED.

An LED module optimized for shooting films and videos for the settings "warm white" and "daylight" is then composed of the following luminous flux portions of the above-specified LED colors and the peak wavelengths thereof:

When a daylight-white luminescent LED is used:

| | Luminous flux portions | |
|---|---|---|
| LED Colour | Warm white | Daylight white |
| BLUE | 0% | 1.3% |
| Daylight white | 45% | 83% |
| GREEN | 23% | 10% |
| YELLOW | 19% | 1.7% |
| RED | 14% | 4% |
| Total | 100% | 100% |

This results, in the setting "warm white" in a color temperature of 3211 K in conjunction with a color rendering index CRI of 92 and very good mixed light capability with incandescent lamps when shooting films and videos and, in the setting "daylight white", in a color temperature of 5800 K in conjunction with a color rendering index CRI of 93 and likewise very good mixed light capability with daylight or HMI light when shooting films and videos.

When a warm-white luminescent LED is used:

| | Luminous flux portions | |
|---|---|---|
| LED Colour | Warm white | Daylight white |
| BLUE | 1.2% | 4.2% |
| GREEN | 21% | 23% |
| YELLOW | 12.3% | 5.8% |
| RED | 10.5% | 3% |
| Warm white | 55% | 64% |
| Total | 100% | 100% |

This results, in the setting "warm white", in a color temperature of 3198 K in conjunction with a color rendering index CRI of 95 and very good mixed light capability and, in the setting "daylight white", in a color temperature of 5800 K in conjunction with a color rendering index CRI of 94 and likewise very good mixed light capability.

Figure 26:
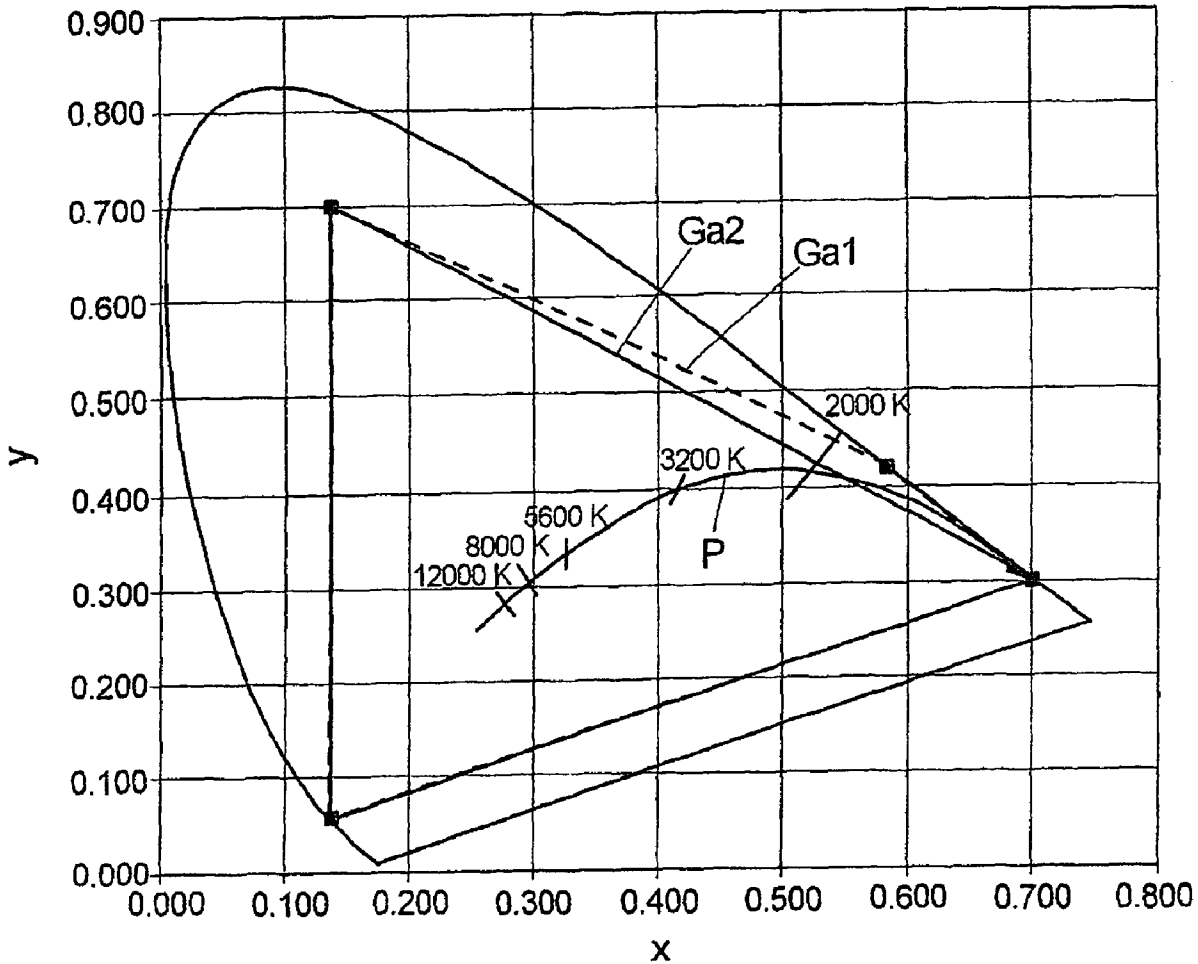
FIG. 26 shows the gamut of the spotlight for two different combinations of LEDs.

The use of the LEDs having the wavelength spectra illustrated in FIG. 25 in combination in an LED module affords the advantage that this results in a large gamut within which the color locus of the LED modules can be set. This is illustrated in FIG. 26, which shows the gamut Ga1 of an LED module having a combination of blue, green, yellow and red color LEDs and a warm-white or daylight-white luminescent LED, and also the gamut Ga2 of an LED module having a combination of blue, green, amber-colored and red color LEDs and a warm-white or daylight-white luminescent LED. An essential advantage of the enlarged gamut Ga1 is that the gamut Ga1 completely encompasses the Planckian locus P even for the setting of very low color temperatures of below 2000 K and in this respect enables the generation of white light having very good color rendering properties with, at the same time, very good mixed light capability.

Figure 27:
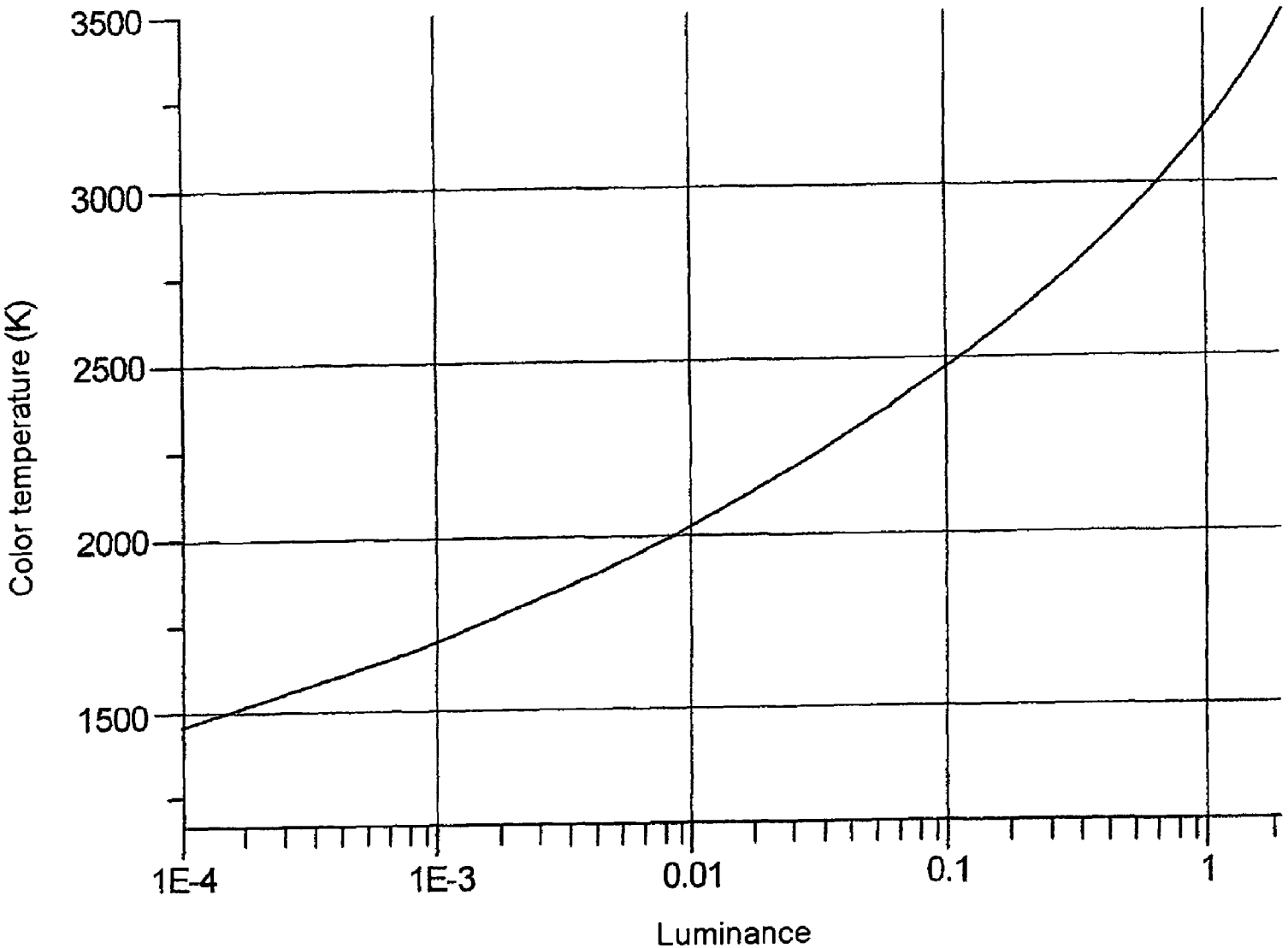
FIG. 27 shows the color temperature-brightness profile representing the dimming characteristic of an incandescent lamp.

The fact that the entire Planckian locus P can be simulated by means of the spotlight can be utilized e.g. for the emulation of the dimming characteristics of an incandescent lamp ("tungsten"), the color temperature of which, as shown in FIG. 27, is dependent on the brightness (luminance) and, particularly when the brightness is low, assumes low values below 2000 K. In order to simulate the light of a dimmed incandescent lamp, the low color temperature corresponding to the dimmed brightness of the incandescent lamp to be simulated can then be set using an LED module having a combination of blue, green, yellow and red color LEDs and a warm-white or daylight-white or yellow-green luminescent LED and with utilization of the large gamut Ga1.

It is then also conceivable in this connection to simulate, in a dimming mode of the spotlight, the dimming profile of an incandescent lamp or some other lamp to be emulated by virtue of the fact that, given variation of the brightness, the color temperature of the spotlight is adapted according to the dimming characteristics of the incandescent lamp or the other lamp.

With utilization of the large gamut Ga1 it is conceivable and advantageous to design the spotlight such that any desired light source and/or light color selected by a user can be set. By way of example, the light color 842 of a fluorescent lamp with a color temperature of 4200 K and a color rendering index CRI of greater than 80 can then be predetermined by a user and be simulated by the spotlight in such a way that an optimum mixed light capability is achieved when shooting films and videos, and color casts are therefore minimized when shooting films and videos, so as then to be used for example as reporting light that can be handled in a simple manner in buildings.

Figure 22:
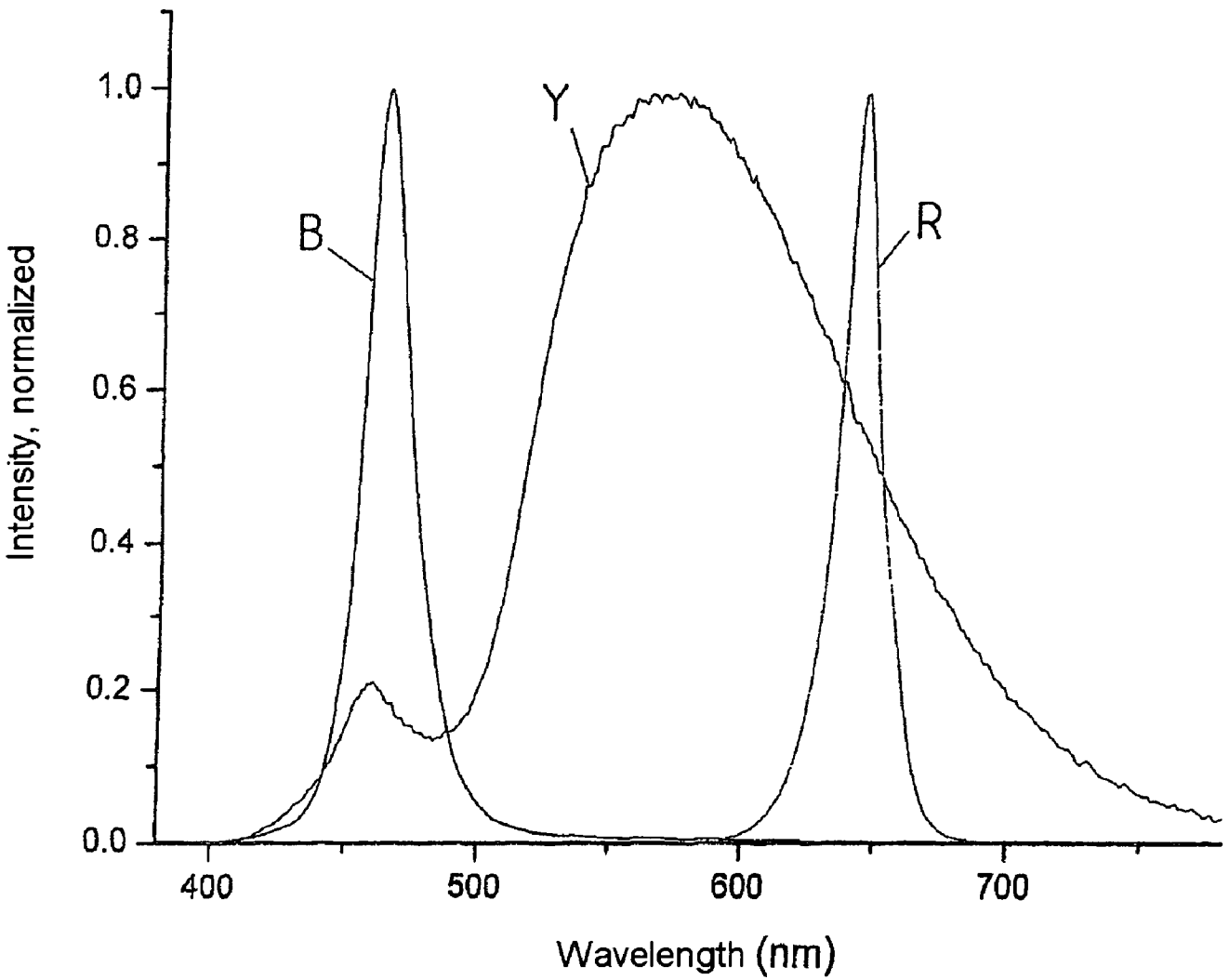
FIG. 22 shows the relative wavelength spectra for blue color LEDs, red color LEDs and also for yellow-green luminescent LEDs.
Figure 23:
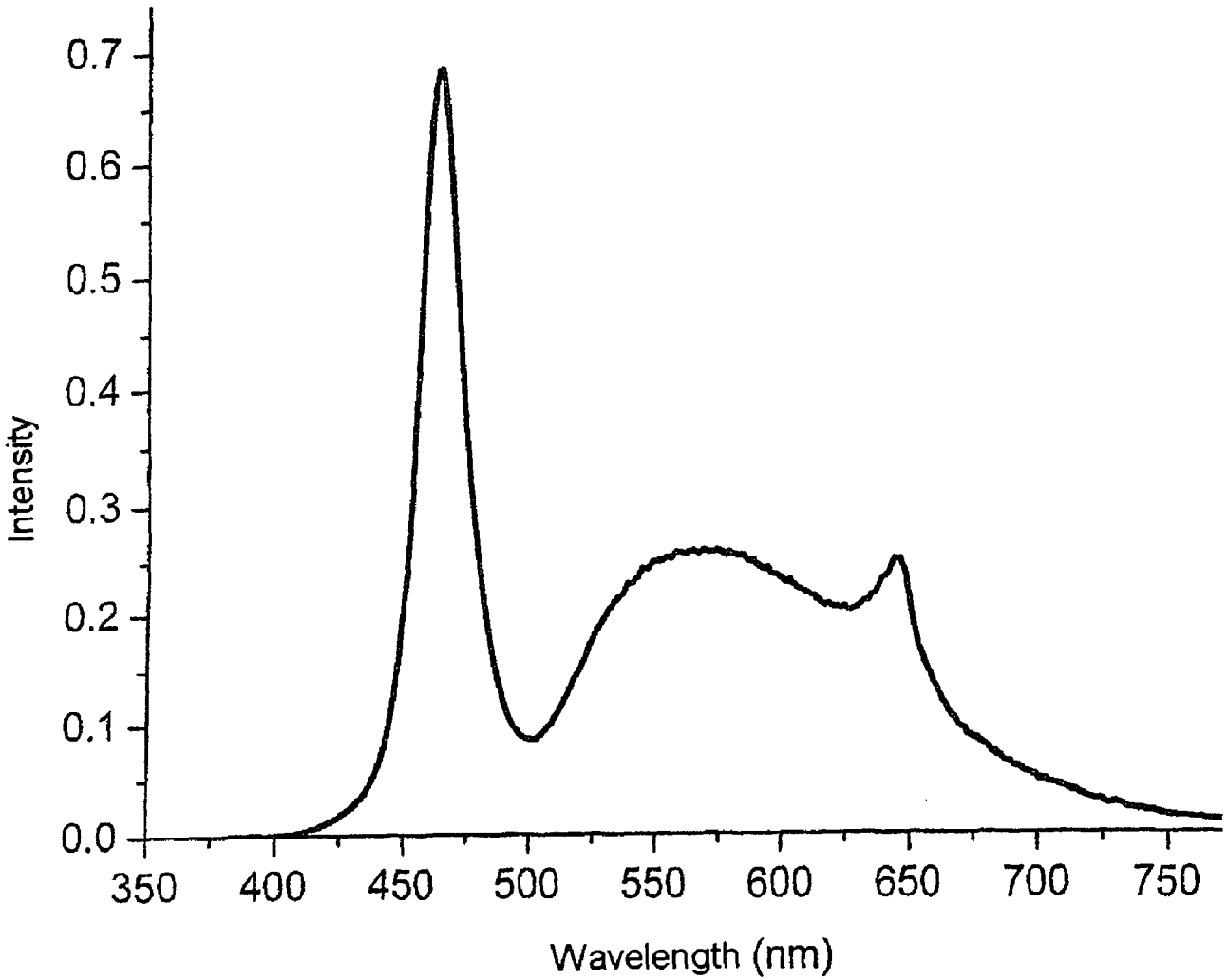
FIGS. 23-24 show the relative wavelength spectra of optimized LED combinations for shooting films and videos with warm-white and daylight-white color temperature.
Figure 24:
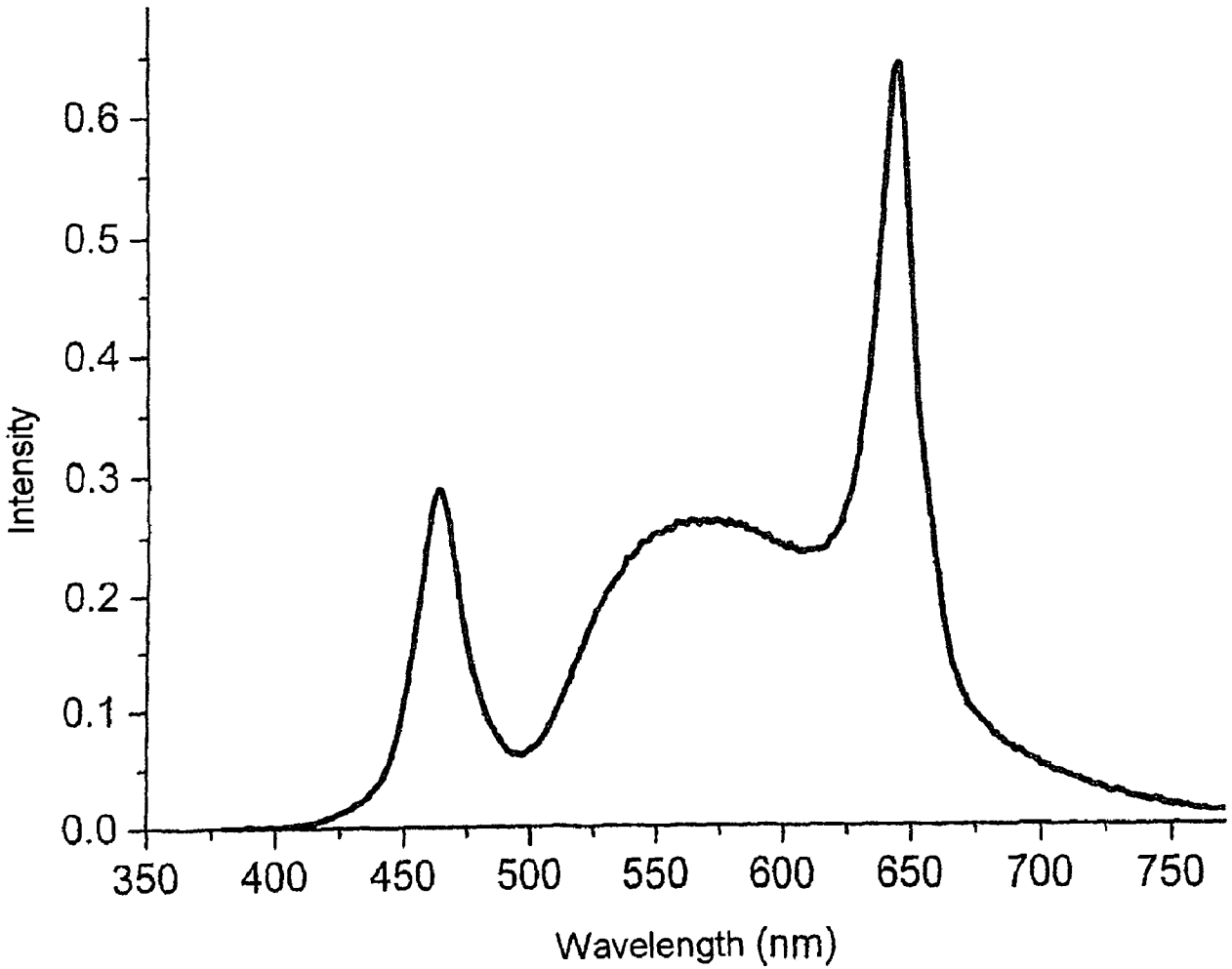

FIG. 22 shows the wavelength spectra used for a further configuration for blue color LEDs 61 (B), red color LEDs 64 (R) and also for a yellow-green luminescent LED (Y) of an LED module, and FIGS. 23 and 24 show wavelength spectra for two optimized LED combinations.

Two exemplary embodiments use the abovementioned LED colors in combination with a yellow-green luminescent LED, the peak wavelengths of which in accordance with FIG. 22 are at the following wavelengths λ:

| | Peak wavelength λ (nm) |
|---|---|
| Colour LED | |
| Blue | 464 |
| Red | 646 |
| Luminescent LED | |
| Yellow-green | 562 |

The two exemplary embodiments concern two LED combinations for the settings "warm white" and "daylight white", the optimized LED combinations containing the abovementioned LED colors blue, red and a yellow-green luminescent LED.

An LED module optimized for shooting films and videos for the settings "warm white" and "daylight white" is composed of the following luminous flux portions of the above-specified LED colors and the peak wavelengths thereof:

| LED color | Warm white | Daylight |
|---|---|---|
| Blue | 2.9% | 8.1% |
| Red | 7.9% | 1.8% |

-continued

| LED color | Warm white | Daylight |
|---|---|---|
| Yellow-green | 89.2% | 90.1% |
| Total | 100.0% | 100.0% |

The following results can be obtained: in the case of a warm-white setting, a color temperature CCT=3224 K in conjunction with a color rendering index CRI=93 and a very good mixed light capability; in the case of a daylight-white setting, a color temperature CCT=5470 K in conjunction with a color rendering index CRI=87 and a good mixed light capability. The wavelength distribution of the setting "daylight" is illustrated in FIG. 23 and the wavelength distribution of the setting "warm white" is illustrated in FIG. 24.

The configuration of FIGS. 22 to 24 has the advantage of a simple embodiment since it comprises only 3 LED colors (yellow-green luminescent LED, blue and red). With small compromises for the daylight-white setting in conjunction with the color rendering index (87 instead of greater than/equal to 90) and only good instead of very good mixed light capability, as a combination of 3 it constitutes a very simple and therefore more cost-effective system.

FIGS. 17*a* to 21*b* show LED spotlights with possible positionings of the light sensor (light sensor, V(λ) sensor, RGB sensor or calorimeter).

The beam shaping is effected for example by means of microoptical elements such as microoptically structured plates for softlight spotlights or lenses for spotlights, if appropriate in conjunction with microreflectors, into which the LEDs are embedded.

Further features of the spotlight may be that the color is measured on line by means of a calorimeter and readjusted in order to compensate for thermal and aging effects.

A control or regulating device provided for this purpose contains at least one measuring device 7 which is preferably regulated to a constant temperature and which receives light from a white diffuser lamina 9, which is arranged between the light-emitting surface and the front or rear side of the spotlight, and is illuminated for example by the LEDs of one or two monitor LED modules situated at a thermally representative location. In order to eliminate incident ambient light for the measurement, the diffuser lamina 9 is reflectively coated toward the top. The light incident on the diffuser lamina 9 is then forwarded onto the measuring device 7, which may be embodied for example as a calorimeter, RGB sensor, V(λ) sensor or light sensor.

Figure 17A:
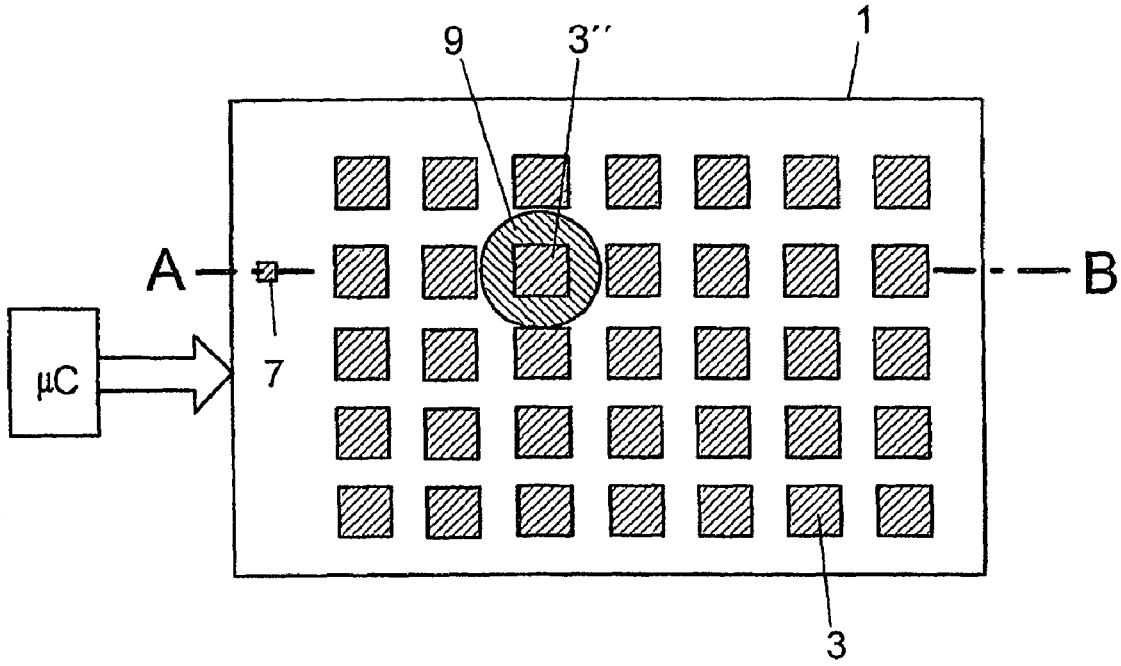
FIG. 17A shows a first exemplary embodiment of an LED spotlight with measuring device in plan view.
Figure 17B:
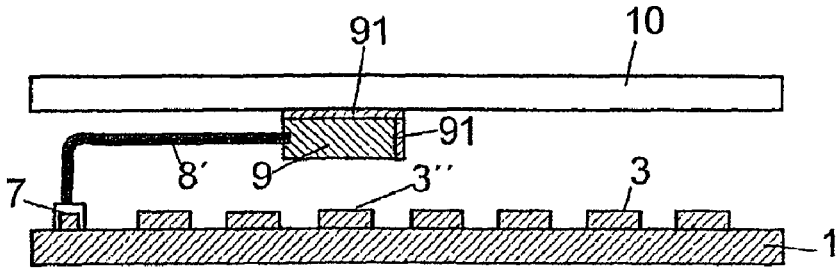
FIG. 17B shows a section through the LED spotlight from FIG. 17*a* along the line A-B.

In concrete terms, in a first exemplary embodiment in FIGS. 17*a*, 17*b*, one of the LED modules 3 arranged on the LED board 1 is provided as monitor LED module 3". The diffuser lamina 9 is arranged on the underside of a screen 10. It has a reflective coating 91 both toward the top and toward the side. The reflective coating 91 eliminates incident ambient light for a measurement. The diffuser lamina 9 is coupled to an optical waveguide 8', which is connected to the measuring device 7, which is arranged in an edge region of the LED board 1 in the exemplary embodiment illustrated. The screen 10 is preferably embodied as a transparent screen or as a diffusing screen and may have a microstructure for the beam shaping of the light emitted by the LED modules 3. The diffuser lamina 9 is produced from PTFE, for example.

The light emitted by the monitor LED module 3" illuminates the diffuser lamina 9 and is guided from the latter onto the measuring device 7 by means of the optical waveguide 8'.

The reflective coating 91 prevents incident ambient light from being taken into account in the measurement.

Figure 18A:
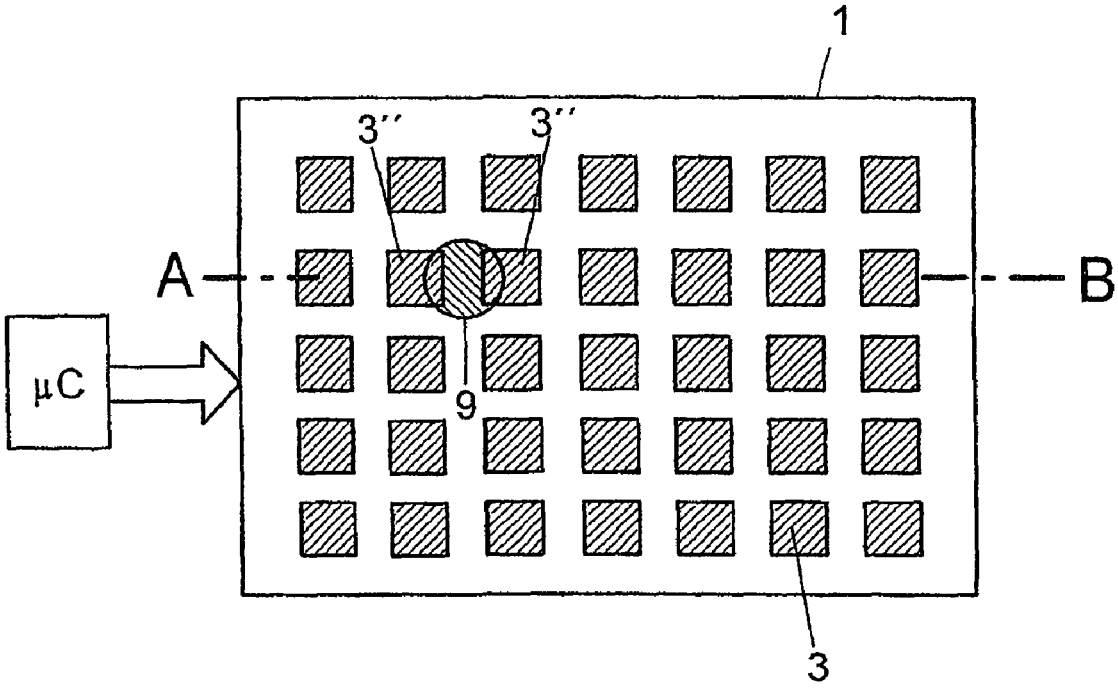
FIG. 18A shows a second exemplary embodiment of an LED spotlight with measuring device in plan view.
Figure 18B:
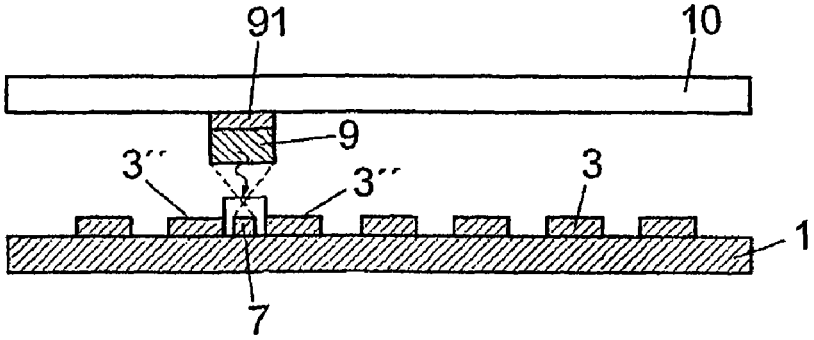
FIG. 18B shows a section through the LED spotlight from 18B along the line A-B.

Two monitor LED modules 3" are provided in the exemplary embodiment in FIGS. 18*a*, 18*b*. The measuring device 7 is situated between said monitor LED modules 3" on the LED board 1. The diffuser lamina 9 is once again situated on the underside of a covering or diffusing screen 10 and has a reflective coating 91 adjoining the screen 10. In this configuration, the light emitted by the monitor LED modules 3" is reflected from the diffuser lamina 9 and detected directly by the measuring device 7. In this case, a housing that is open in the direction of the diffuser lamina 9 may be situated above the measuring device 7 for the purpose of aperture adaptation. The height of such a housing is configured in such a way that the aperture of the measuring device or the sensor 7 is coordinated with the diffuser lamina 9 and laterally incident light is shaded.

Figure 19A:
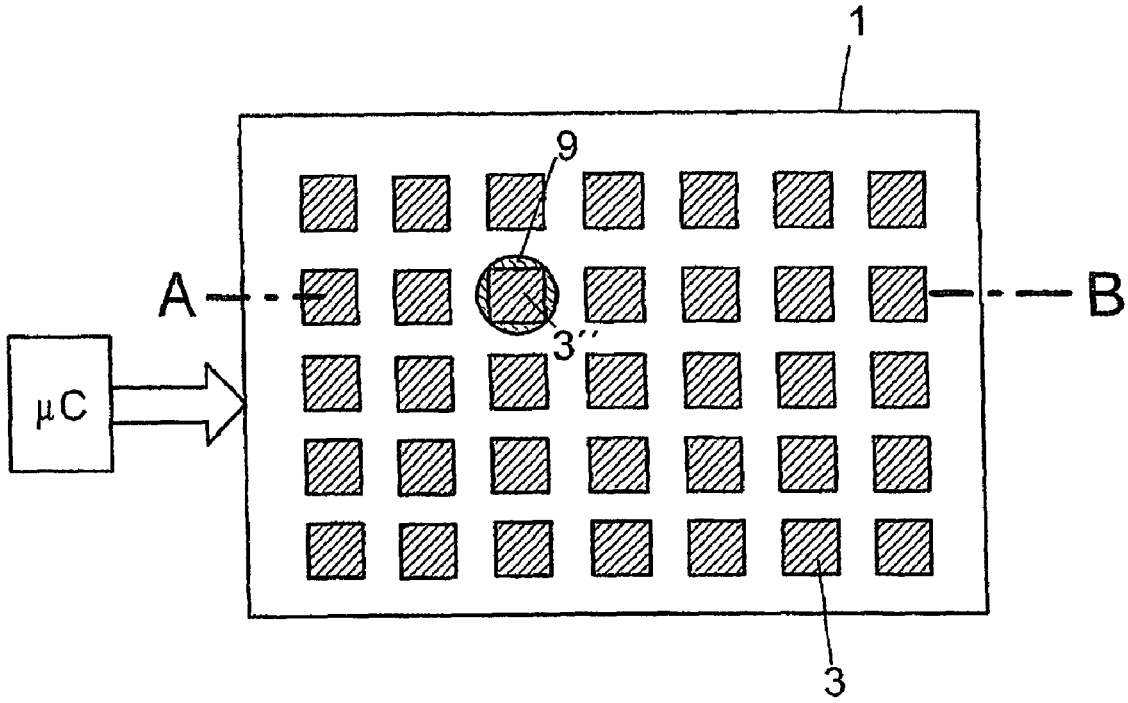
FIG. 19A shows a third exemplary embodiment of an LED spotlight with measuring device in plan view.
Figure 19B:
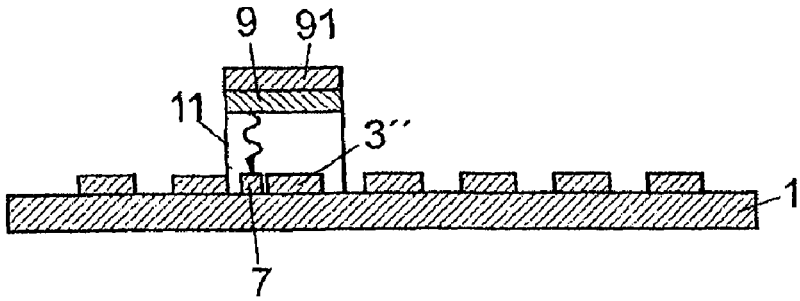
FIG. 19B shows a section through the LED spotlight from FIG. 19A along the line A-B.

In the exemplary embodiment of FIGS. 19*a*, 19*b*, in a manner similar to that in the exemplary embodiments in FIGS. 18*a*, 18*b*, the measuring device 7 (preferably embodied as a sensor chip) is arranged alongside a monitor LED module 3" on the LED board 1. The measuring device 7 is illuminated directly by light reflected from the diffuser lamina 9. No diffusing or covering screen is present in this configuration. The diffuser lamina 9 is situated in a measurement window capsule 11, which is preferably formed in light-tight fashion and for this purpose is reflectively coated or white on the inside, for example. The diffuser lamina once again has a reflective layer on the side remote from the sensor 7. The measurement window capsule 11 is placed onto the LED board 1 above the monitor LED module 3" and the measuring device 7.

Figure 20A:
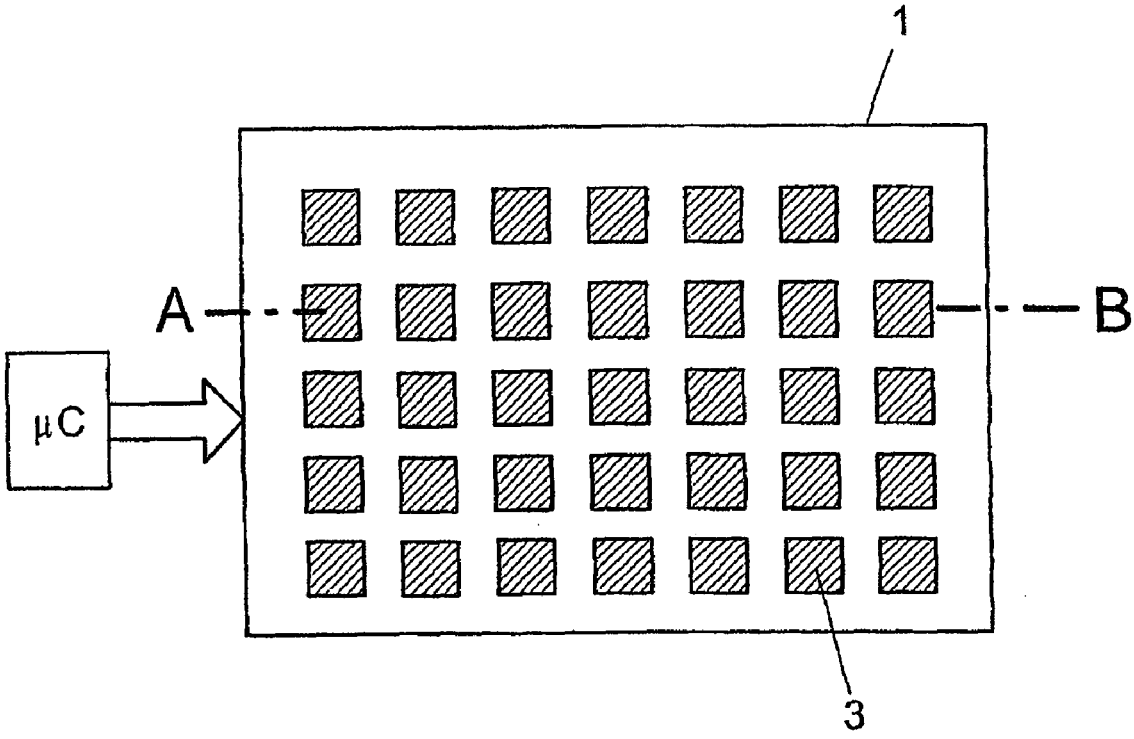
FIG. 20A shows a fourth exemplary embodiment of an LED spotlight with measuring device in plan view.
Figure 20B:
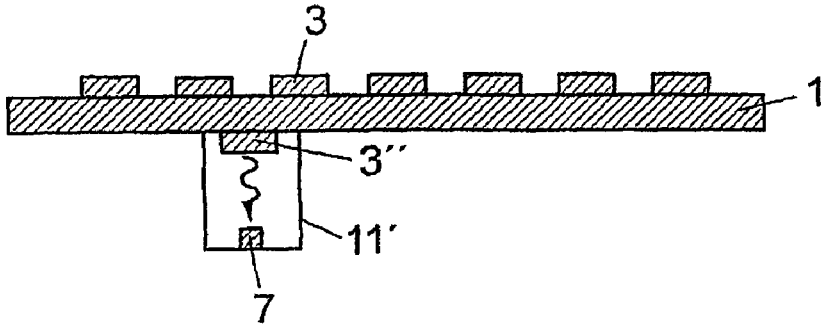
FIG. 20B shows a section through the LED spotlight from FIG. 20A along the line A-B.

In the configuration in FIGS. 20*a*, 20*b*, a monitor LED module 3" is situated on a thermally representative location on the rear side of the LED board 1. In this configuration, the measuring device 7 is situated in a measurement window capsule 11' arranged over the monitor LED module 3". The monitor LED module 3" illuminates the measuring device 7 directly. The measurement window capsule 11' is preferably embodied such that it is light-tight and for this purpose inwardly white, black or reflectively coated. One advantage of this configuration is that it is invisible to the user. A further advantage is that the light from the monitor LED module 3" does not contribute to the useful radiation of the spotlight. The monitor LED module can therefore be connected up independently of the other LED modules and a measurement of the present LED luminous flux portions can be carried out at any desired point in time without this being able to give rise to disturbing brightness fluctuations in the course of shooting films or videos.

Figure 21A:
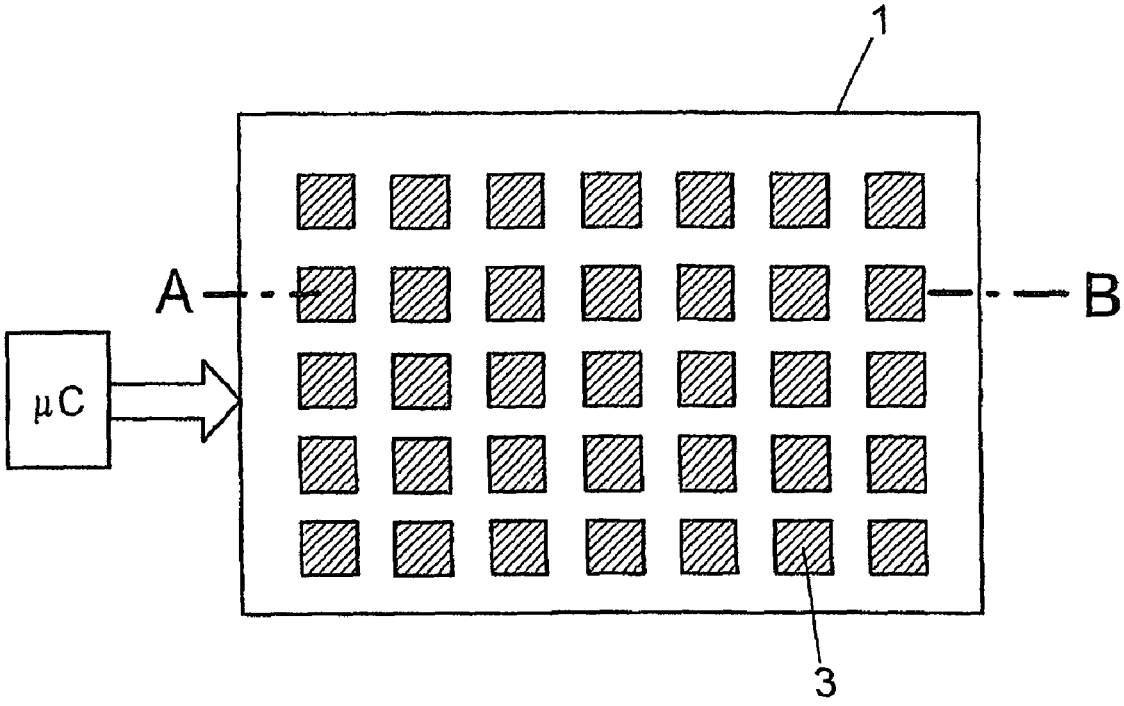
FIG. 21A shows a fifth exemplary embodiment of an LED spotlight with measuring device in plan view.
Figure 21B:
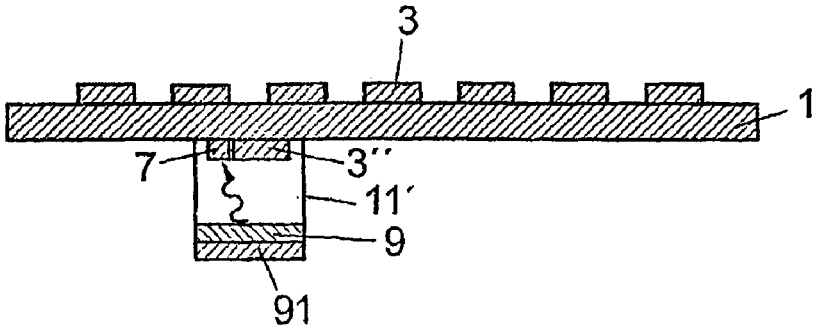
FIG. 21B shows a section through the LED spotlight from FIG. 21A along the line A-B.

In the exemplary embodiment in FIGS. 21*a*, 21*b*, the measuring device 7 is likewise situated on the rear side of the LED board 1. Analogously to FIGS. 19*a*, 19*b*, the measuring device 7 is illuminated by means of the light reflected from a diffuser lamina 9 in a measurement window capsule 11'. In this case, the measuring device 7 is situated alongside the monitor LED module 3" on the underside of the LED board 1 and within the measurement window capsule 11'. The latter is once again embodied in light-tight fashion.

A further embodiment is shown in FIGS. 9*a*, 9*b*. In this configuration, the LEDs 5 are embodied as side-emitting LEDs. An arrangement with five groups comprising side-emitting LEDs is preferably provided, wherein one LED group comprises white luminescent LEDs and four LEDs groups comprise color LEDs. Each of the five groups thus comprises side-emitting LEDs of a specific color. The luminous flux portions of the five colors of the side-emitting LEDs are driven in each case in groups in order to be able to set the desired color or color temperature.

By way of example, 11 times 17 side-emitting LEDs, that is to say 187 items, are provided, which are divided among five colors as follows: 17 cyan-colored color LEDs having a peak at 501 nm, 32 green color LEDs having a peak at 522 nm, 103 daylight-white luminescent LEDs, 24 yellow color LEDs having a peak at 593 nm and 11 red color LEDs having a peak at 635 nm.

The light emerging from the side-emitting LEDs 5 is coupled into a light guiding plate 12, which, by means of multiple reflections, produces a light mixture and, consequently, a uniformly luminous and homogeneously colored surface. The light guiding plate 12 has a reflective coating or a highly reflective optical layer 13 toward the bottom. Lateral reflective coatings 14 are also provided in order to avoid light losses due to laterally emerging light. Toward the top, the light guiding plate 12 can be either clear or formed with an optical microstructure for targeted beam directing (not illustrated).

Holes 15 for the LEDs 5 are introduced into the light guiding plate 12 and the reflective lower layer 13, said holes not being made right through, however. The holes 15 have bevels 151 at their top side, which bevels have the effect that an upwardly emerging radiation component of the LEDs 5 is likewise coupled laterally into the light guiding plate 12 and the homogeneity is thus improved further.

A small opening 16 is introduced into the peripheral reflective coating 14, the sensor chip 7 being arranged in said small opening. Said sensor chip therefore detects the intensity of all the LEDs.

For the control and regulation it suffices if the sensor 7 in each embodiment receives per LED color a constant luminous flux portion which is directly proportional to the total luminous flux portion of the LED color of the spotlight. By means of the calibration of the spotlight (see FIG. 14, calibration flowchart), the required intensity correction factors and dimming characteristics are determined per color and stored in the internal memory for each spotlight.

The measurement of the individual LED colors can be initiated manually and an optical and/or acoustic signal device can indicate the deviation of the present setting from a predetermined desired value.

Preferably, the desired color temperature and/or the desired color locus and/or an emulation of color correction filters placed in front is input by means of a user interface.

The color correction can also be effected and carried out in the form of an input of "plus/minus green" for color shifts along the Judd straight line or an input of a CTO or CTB value for color shifts along the Planckian locus. In this case, predetermining a CTO value (CTO: color temperature orange) means a reduction of the most similar color temperature, and in contrast a CTB value (CTB: color temperature blue) means an increase in the most similar color temperature. These values generally serve for specifying color correction filters and are concomitantly specified by manufacturers of typical color correction filters.

Figure 10A:
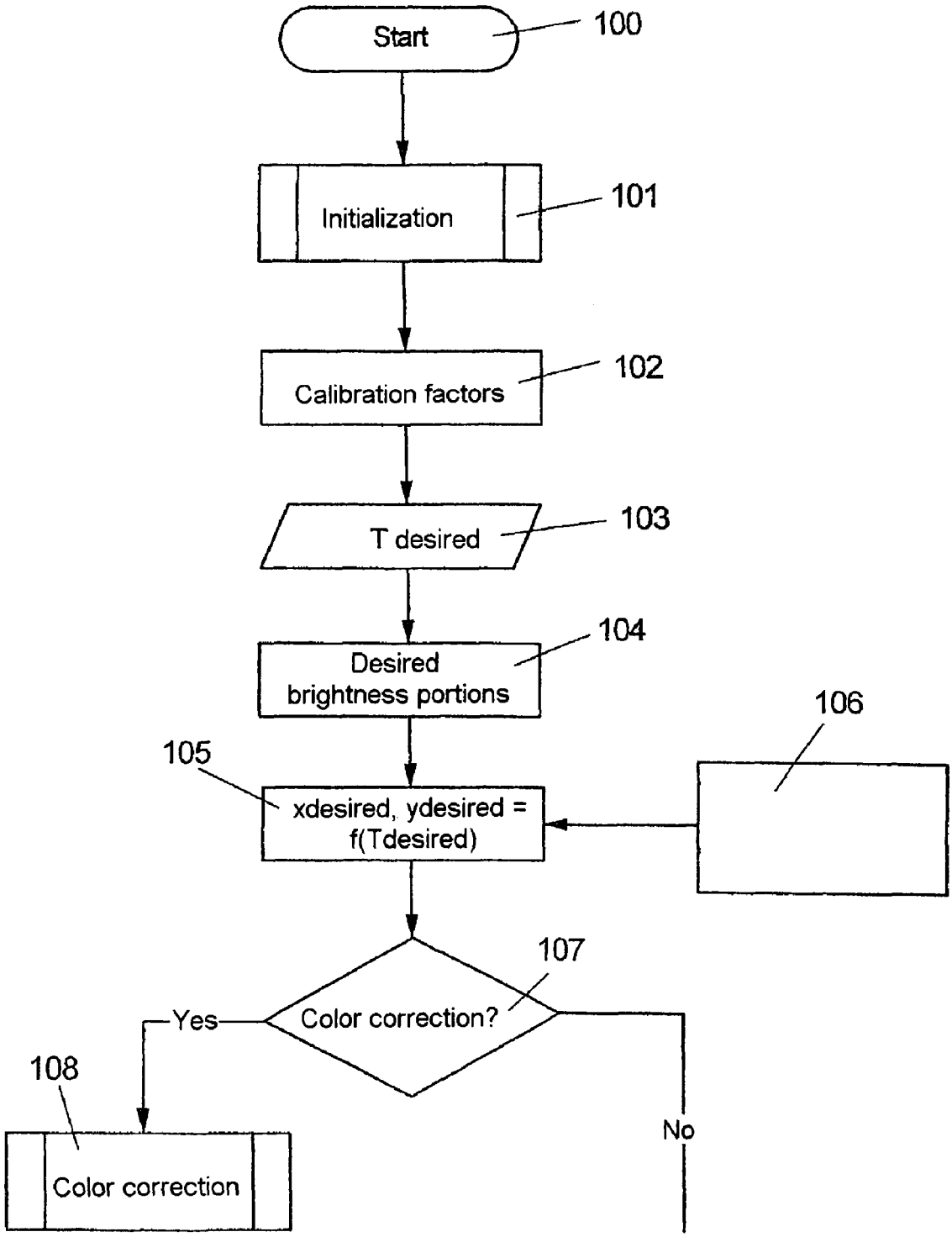
FIGS. 10A-10C show a flowchart for color setting and color regulation of an LED spotlight.
Figure 10B:
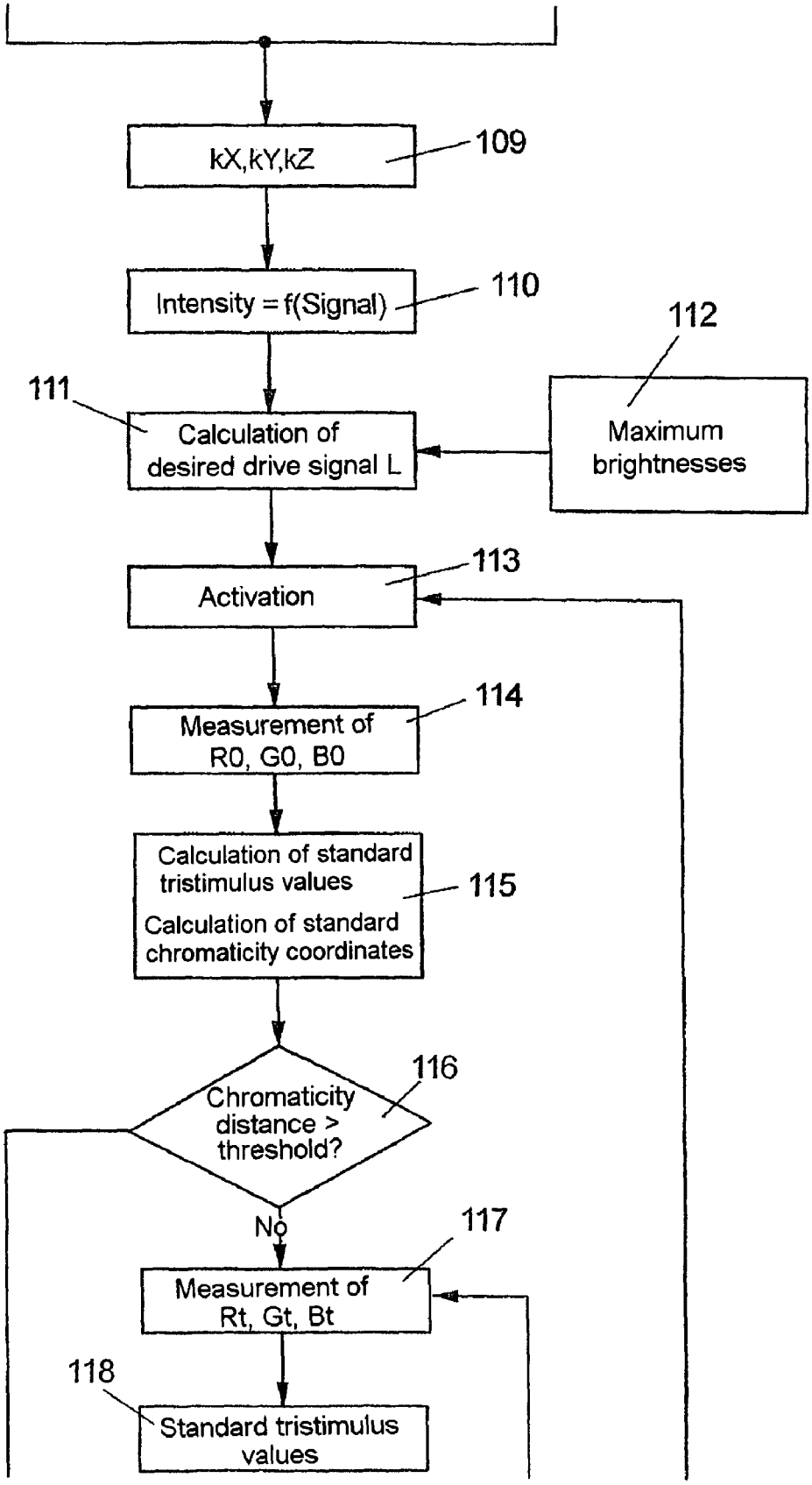
Figure 10C:
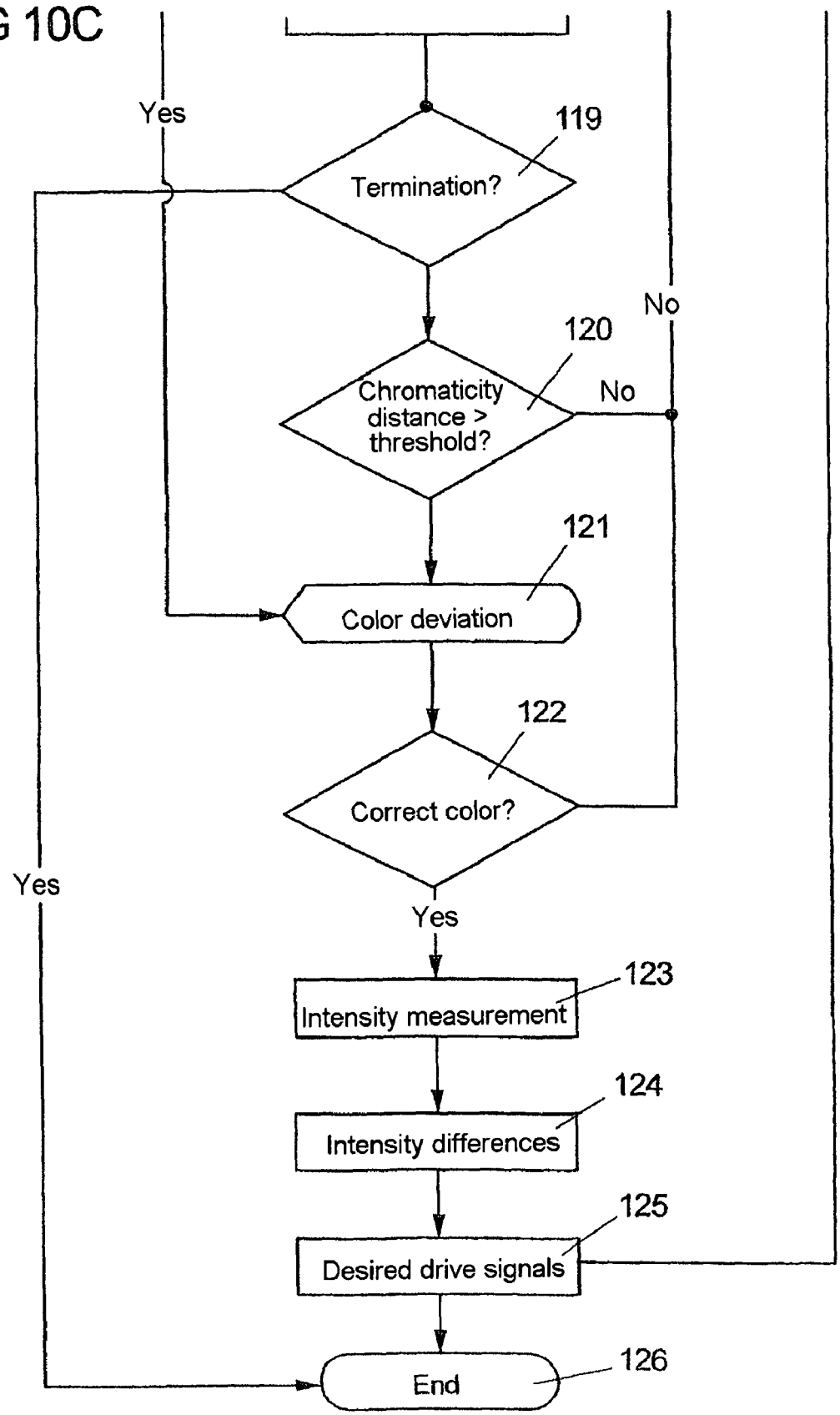
Figure 11:
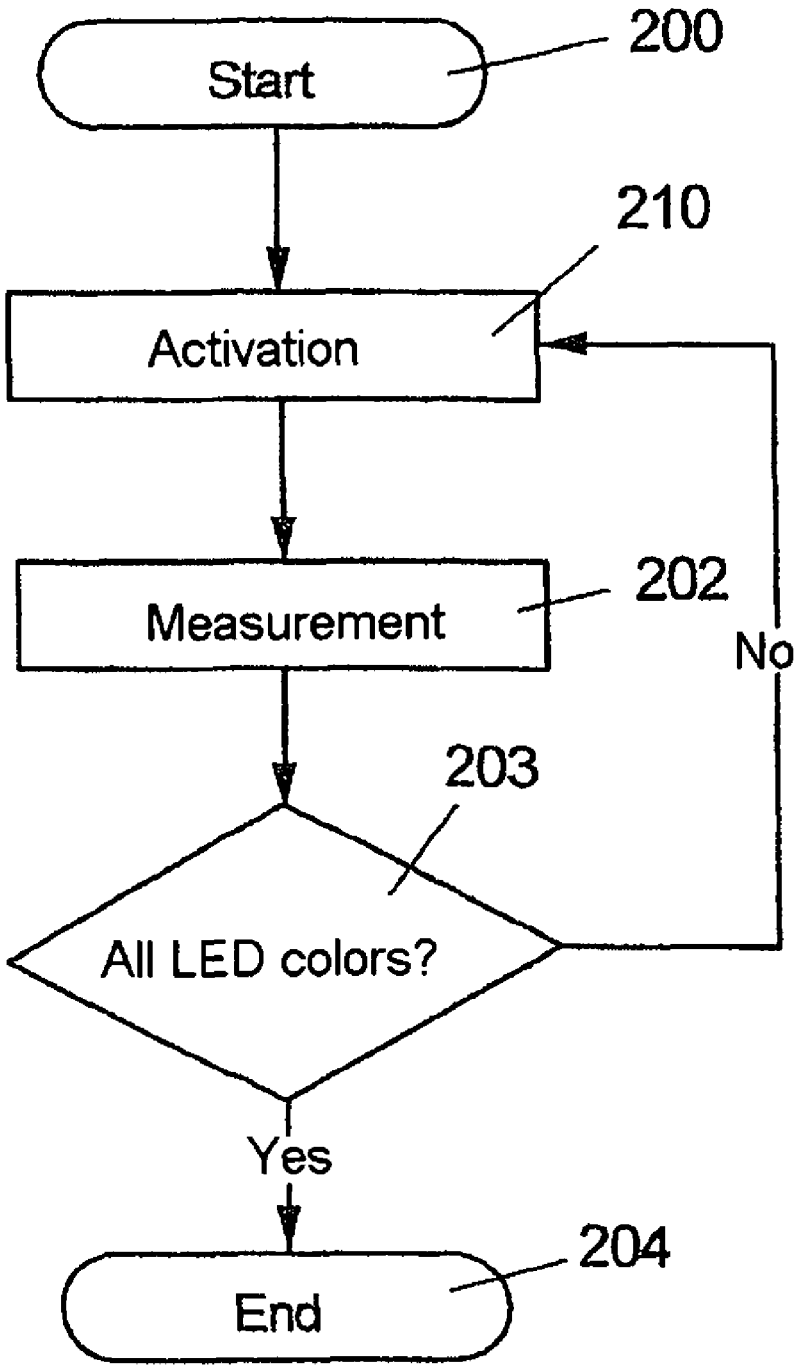
FIG. 11 shows a flowchart for an individual intensity measurement of the LEDs.
Figure 12:
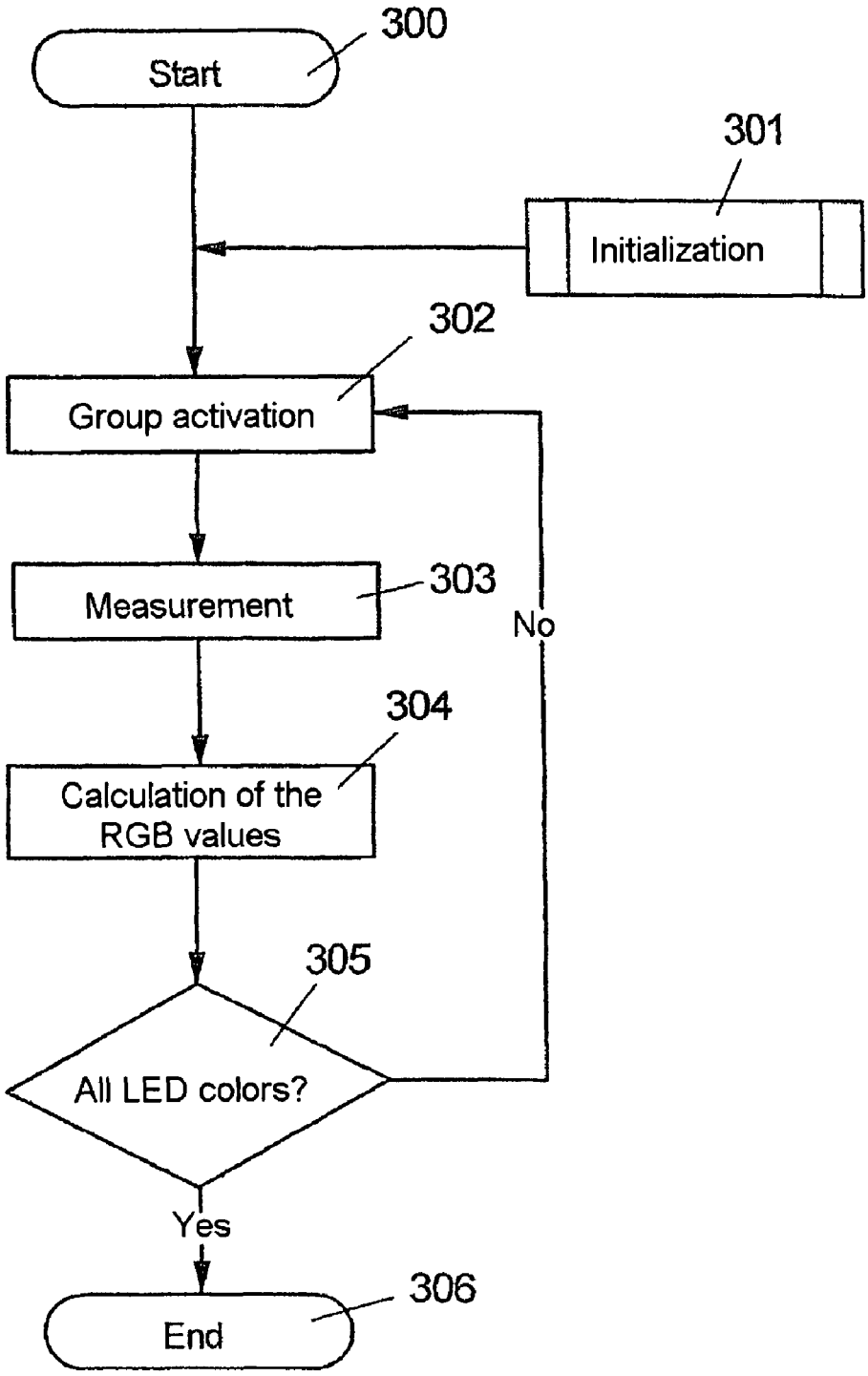
FIG. 12 shows a flowchart for the alternative grouped intensity measurement of the LEDs.
Figure 13:
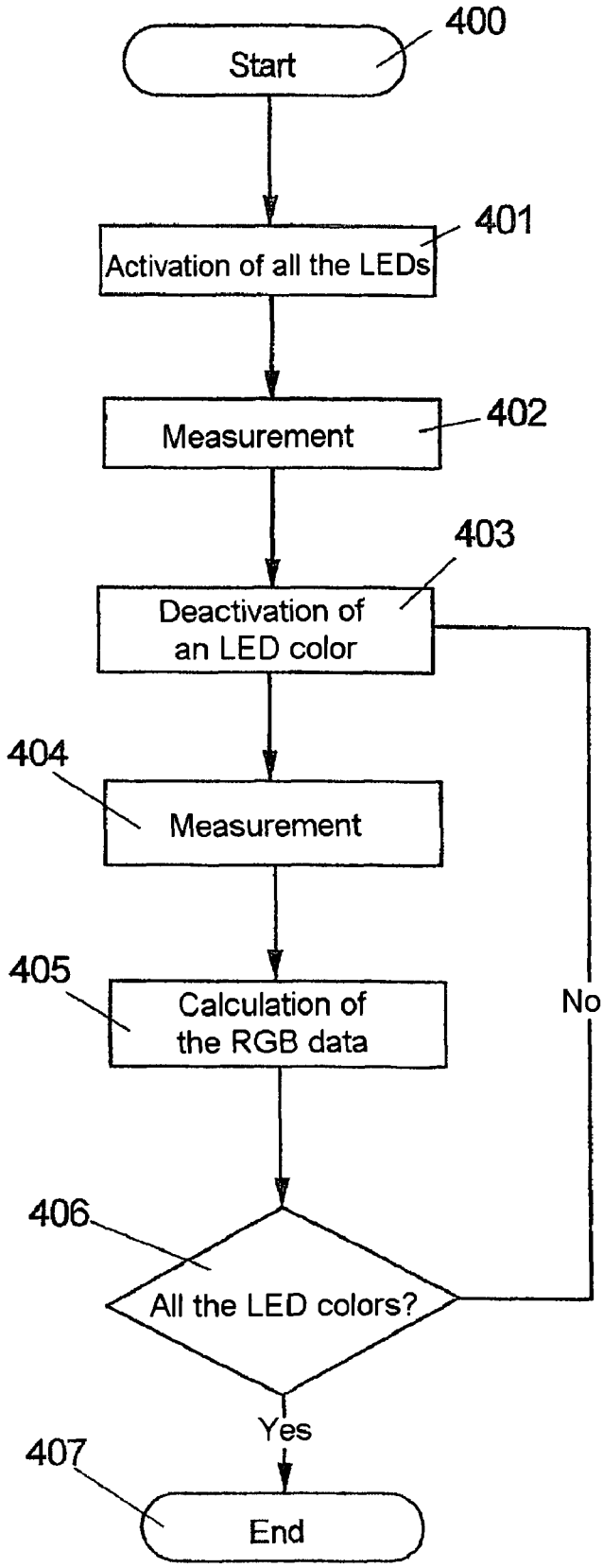
FIG. 13 shows a flowchart for a subtractive intensity measurement of the LEDs.

The flowchart of a program for the color setting and regulation of an LED spotlight as illustrated in FIGS. 10*a* to 10*c* begins, after the start 100, with an initialization 101 for measuring the intensity of the LED colors, which are carried out according to one of the subsequent flowcharts illustrated in FIGS. 11 to 13 and are measured for example according to the flowchart in accordance with FIG. 11 individually and in each case at 100%. Afterward, in program step 102, the calibration factors kX, kY, kZ are read in from an EEPROM memory and the user is subsequently requested, in step 103, to input the desired color temperature Tdesired.

In the subsequent step 104, the desired brightness portions for the settings "tungsten" and "daylight" are read in from the EEPROM memory and this is followed by the calculation of the desired brightness portions of the LED colors for the target color locus having the coordinates xdesired, ydesired as a function of the desired color temperature Tdesired in program step 105.

The calculation method 106 involves firstly determining the target color locus having the coordinates x and y as a function of the desired color temperature Tdesired, and then carrying out a linear interpolation of the basic mixtures for "tungsten" and "daylight" to the target color locus determined by the coordinates x and y.

Since the two basic mixtures for warm white and daylight white (approximately 3200 K and 5600 K) can be calculated exactly on Planck, small deviations from the Planckian locus occur in the case of a linear interpolation between these two color loci, which deviations are all the greater, the further away the color temperature is from one of the two basic mixtures. However, the deviations are at most $\Delta y=0.006$ and therefore at most 2 threshold value units and can therefore be disregarded, especially as these maximum deviations occur in a color temperature range around 4000 K . . . 4500 K that is not of interest for shooting films and videos.

The next step 107 involves deciding whether a color correction with filters is to be emulated and, in the event of a confirmation, the desired brightness portions of the LED colors that are determined for the new target color locus xdesired, ydesired are calculated in step 108. It is followed by a program step 109 for calculating the correction factors kX, kY and kZ for the color mixture set, and the characteristic curves for each LED color are subsequently read in in step 110.

After a calculation of the desired drive signals of the LED colors for xdesired, ydesired from the desired brightness values and the characteristic curves for each LED color (step 111) taking account of the maximum brightnesses measured during the initialization for each LED color for maximum brightness modulation (block 112), the LEDs are activated with desired drive signals in program step 113 and the tristimulus values R0, G0, B0 of the total radiation are measured in step 114.

This is followed, in program step 115, by a calculation of the standard tristimulus values $$X0=kX*R0$$

$$Y0=kY*G0$$

$$Z0=kZ*B0$$

and of the standard chromaticity coordinates for the coordinates x0 and y0 of the color locus $$x0=f(X0,Y0,Z0)$$

$$y0=f(X0,Y0,Z0)$$

as a function of the standard tristimulus values X0, Y0 and Z0.

The subsequent program step 116 involves deciding whether the chromaticity distance between x0, y0 on the one hand and xdesired, ydesired is greater than a predetermined threshold value. If this is the case (YES), then the program jumps to step 121 and a warning "color deviation" is issued. If this is not the case, then the values Rt, Gt and Bt are measured in step 117 and standard tristimulus values Xt, Yt and Zt and also standard chromaticity coordinates xt and yt are calculated therefrom in program step 118.

If a termination of the program is decided on in the subsequent decision block 119, the program jumps to the end 125. Otherwise, step 120 involves deciding whether the chromaticity distance between the standard chromaticity coordinates for the coordinates x0 and y0 of the color locus on the one hand and the standard chromaticity coordinates xt, yt is greater than a predetermined threshold value. If this is the case (YES), then the warning "color deviation" is likewise effected in step 121. If this is not the case (NO), then the program jumps back to step 117 and, after a measurement of the values Rt, Gt and Bt, once again passes through the loop described above.

After the warning "color deviation" has been issued, in program step 122 a decision is taken about a color correction, which, in an affirmative case, leads in step 123 to an intensity measurement of the LED colors individually, subtractively or in grouped fashion according to the flowcharts illustrated in FIGS. 11 to 13. In a negative case, the program jumps back to step 117 and, after a measurement of the values Rt, Gt and Bt, once again passes through the loop described above.

After a calculation of the required intensity differences for each LED color, the last program step 125 involves calculating the corrected desired drive signals for each of the predetermined LED colors.

FIG. 11 shows a flowchart for an individual intensity measurement of the LEDs. After the start of the program, e.g. in the first program step 100 or at start 200, the LED colors are individually activated in program step 201 and their RGB or intensity values Ri, Gi and Bi are measured in program step 202. In the subsequent decision block 203, the decision is taken as to whether all the predetermined LED colors have been measured. If this is answered in the negative, then the program jumps back to program step 201. After all the LED colors have been activated and measured, the program is ended with program step 204.

In the flowchart illustrated in FIG. 12 for the alternative grouped intensity measurement of the color LEDs, after the program start in initial step 300 and an initialization of the intensity measurement of the individual color LEDs at 100% in program step 301 (Ri_100, Gi_100, Bi_100), program step 302 involves carrying out a group activation with in each case two or three LED colors simultaneously. This is followed by a measurement of the RGB values of the mixed radiation Rm, Gm and Bm of the LED group in program step 303.

This is followed, in program step 304, by a calculation of the RGB values of the involved LED colors #1, #2, if appropriate also #3, in accordance with the equations $$Rm=k1*R1_100+k2*R2_100+k3*R3_100$$

$$Gm=k1*G1_100+k2*G2_100+k3*G3_100$$

$$Bm=k1*B1_100+k2*B2_100+k3*B3_100$$

$$R1=k1*R1_100$$

$$G1=k1*G1_100$$

$$B1=k1*B1_100$$

$$R2=k21*R2_100$$

$$G2=k2*G2_100$$

$$B2=k2*B2_100$$

$$R3=k3*R3_100$$

$G3=k3*G3_100$ $B3=k3*B3_100$

Program step 305 involves deciding whether all the LED colors have been measured in groups, and the program is either concluded with the END 306 or jumps back to program step 302.

In the configuration of FIGS. 22 to 24, with only three colors the method for color measurement and possible regulating steps can be realized significantly more simply since, after an initial measurement at the start of the program, during the operation of the spotlight, the luminous flux portions of the 3 LED colors could be determined from the RGB signal of the total radiation unambiguously, simultaneously analogously to the group activation of up to 3 colors as described for FIG. 12. In the case of deviations with respect to the predetermined target color locus, a "warning" to the user would thus be obviated since the manually or automatically initiated "flashing" of the individual LED colors, in order to determine the luminous flux portions thereof, could be avoided. Instead, the color locus could be readjusted immediately, continuously and without any disturbance for the user or for the camera.

FIG. 13 shows a flowchart for a subtractive intensity measurement of the LEDs. After the program start (start 400) and an activation of all the LEDs in program step 401, a measurement of the RGB values of the total radiation Rg, Gg and Bg of the RGB values is effected in program step 402. After an individual deactivation of a respective LED color in program step 403, the RGB or intensity values Rgi, Ggi, Bgi are measured in program step 404 and afterward, in program step 405, the RGB data of the respective LED color are determined according to the equations $Ri=Rg-Rgi$ $Gi=Gg-Ggi$ $Bi=Bg-Bgi.$ This loop is iterated according to the decision block 406 until it is ascertained that all the LED colors have been measured, such that the end of the program is reached in program step 407.

Figure 14:
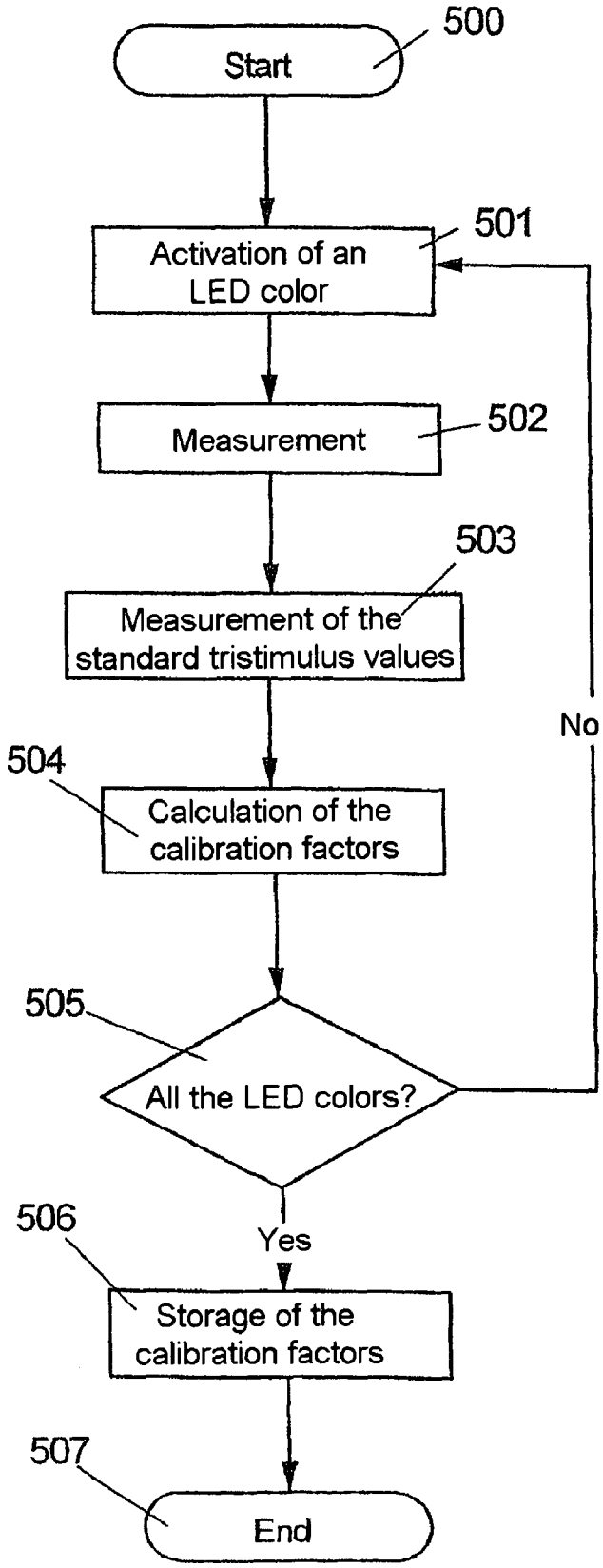
FIG. 14 shows a flowchart for determining and calibrating color correction factors.

FIG. 14 shows a flowchart for determining the color correction factors for a calibration that are used in program step 109 of the program for the color setting and regulation of an LED spotlight in accordance with FIGS. 10*a* to 10*c*.

After the program start 500, in program step 501 the LED colors are activated individually and at 100%. Afterward, their RGB data Ri, Gi, Bi are measured by means of an integrated RGB sensor in program step 502, and the standard tristimulus values Xi, Yi, Zi of the LED colors are measured by means of an external precision measuring instrument in program step 503. Afterward, in program step 504 the calibration factors for the sensor are calculated from both measurements according to the equations $kXi=Xi/Ri$ $kYi=Yi/Gi$ $kZi=Zi/Bi.$ This loop is iterated according to the decision 505 until all the LED colors have been measured, and, afterward, the calibration factors kXi, kYi and kZi are stored in a memory in program step 506 and the program is concluded with the END 507.

Figure 15:
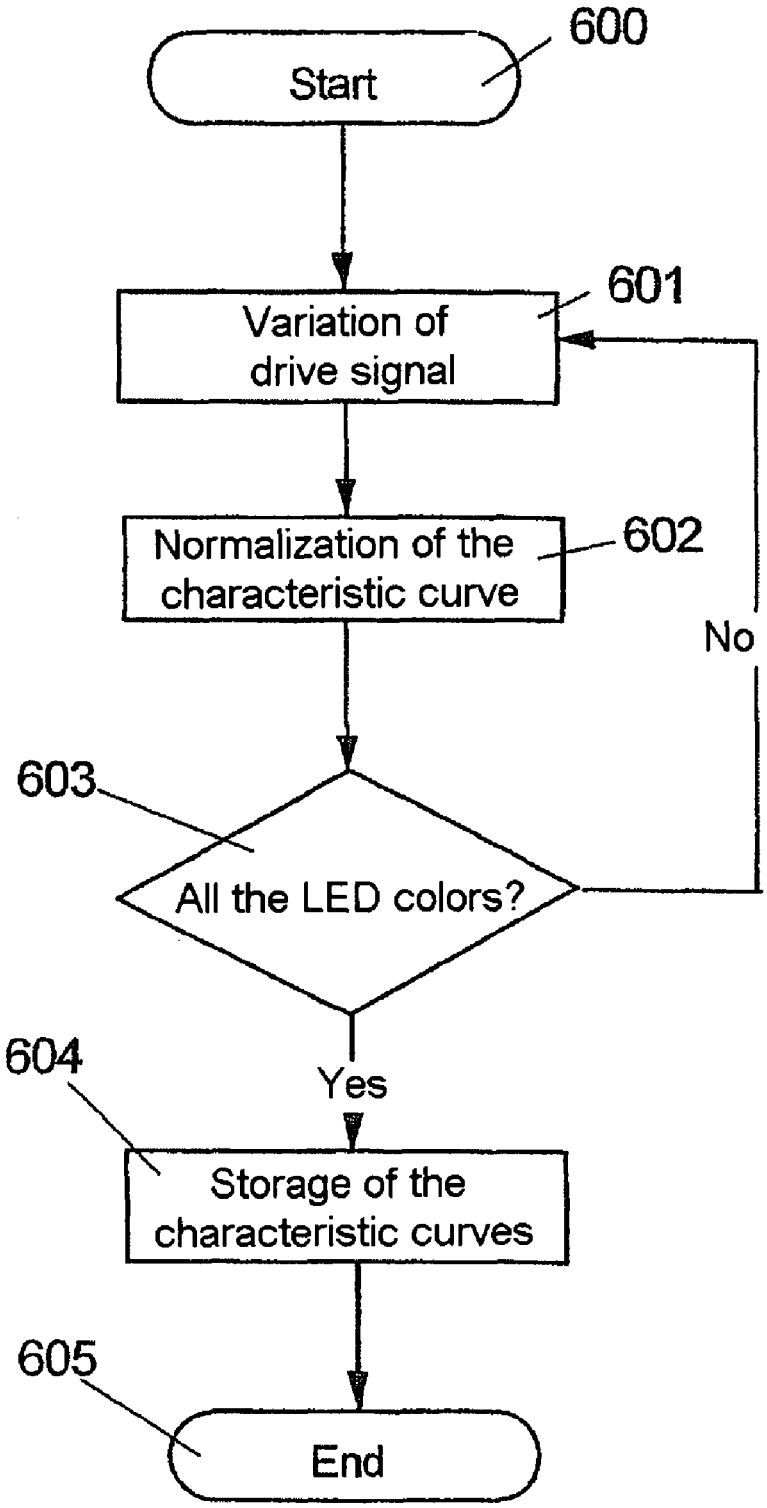
FIG. 15 shows a flowchart for determining and calibrating brightness characteristic curves.

FIG. 15 shows a flowchart for determining characteristic curves for the brightness depending on the drive signal for calibrating the LED modules. After the start 600 of the program, in program step 601*a* variation of the drive signal from 0 to 100% is performed for each color LED and the brightness Gi is measured depending on the drive signal. This characteristic curve is ideally determined by means of an external sensor. After a normalization of the characteristic curve in program step 602 to $Gi_{max}=100\%$, this loop is iterated according to the decision 603 until all the LED colors have been measured. Afterward, the characteristic curves in the form Gi=f (drive signal) are stored in the memory in program step 604 and the program is ended in step 605.

Figure 16:
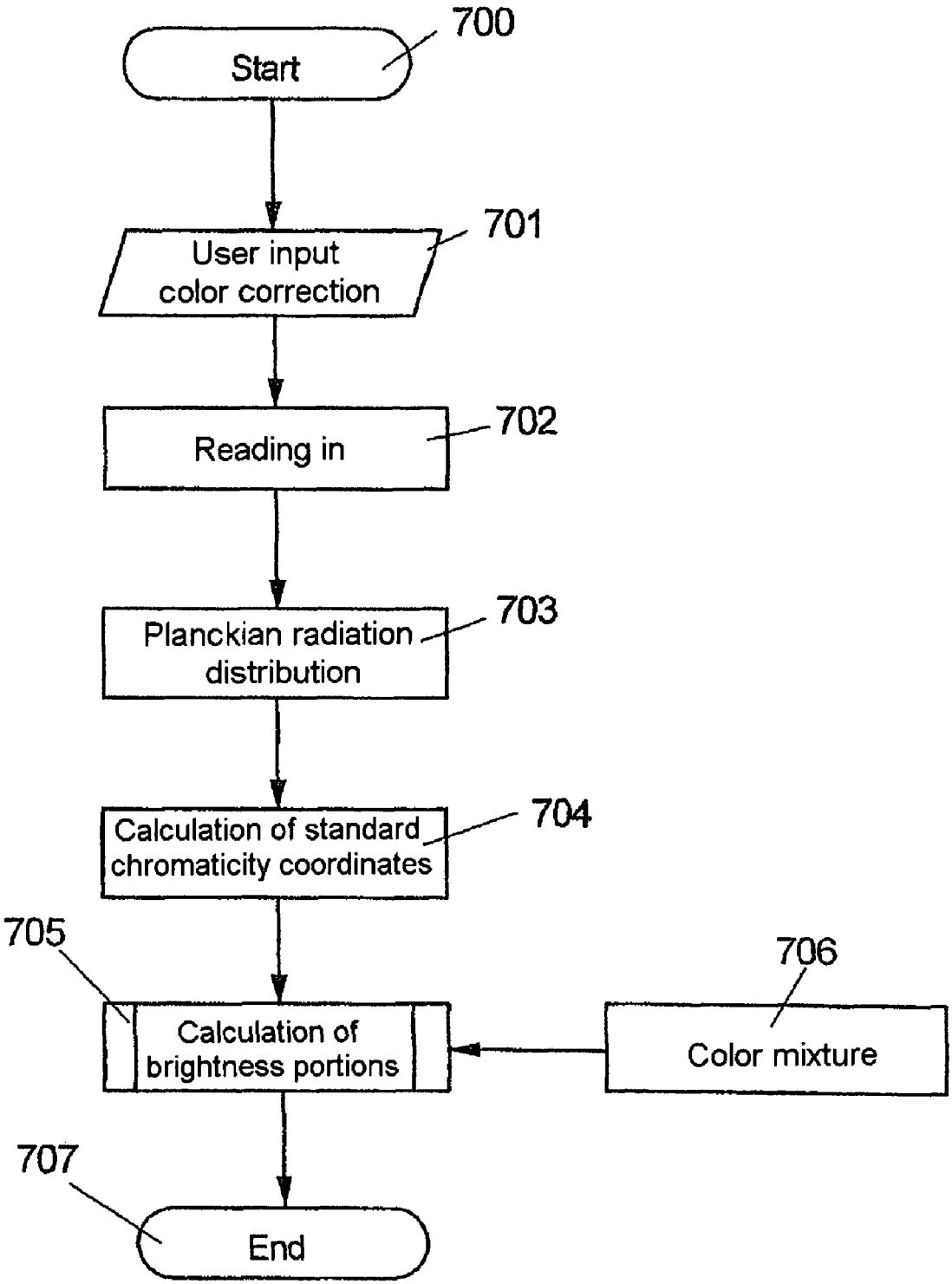
FIG. 16 shows a flowchart for emulating color filters.

FIG. 16 shows a flowchart for the emulation of color filters for a color correction of the LED modules such as is used in program step 108 of the program for the color setting and regulation of an LED spotlight.

After the start of the program in program step 700, program step 701 involves a user input of the color correction after selection of one or more color filters (e.g. ½ minus green). This is followed, in program step 702, by a reading in of the spectral transmission(s) $\rho_1(\lambda) \ldots \rho_n(\lambda)$ of the selected filters or filter from a memory. Program step 703 involves calculating the Planckian radiation distribution for the set color temperature TDESIRED according to the function $SPlanck=f(Tdesired)$ Program step 704 subsequently involves calculating the standard chromaticity coordinates x, y of the filter or filter combination in the case of a transillumination with Planckian radiation having the color temperature $T_{DESIRED}$ according to the equations $Srel(\lambda)=\rho_1(\lambda)* \ldots *\rho_n(\lambda)*SPlanck(\lambda)$ $X,Y,Z=f(Srel)$ $x,y=f(X,Y,Z)$ Finally, program step 705 involves calculating the required brightness portions for the setting of the color locus with the coordinates x and y, wherein, in accordance with program step 706, a color mixture contains the maximum contribution of the LED combination for TDESIRED in order to maintain the color quality of the optimized mixture in the best possible manner. The program for the emulation of color filters for a color correction of the LED modules is ended with program step 707.

The program for the color setting and regulation of an LED spotlight which is illustrated in FIGS. 10*a* and 10*c* and described above, and the subroutines that are illustrated in FIGS. 11 and 16 and described above represent only a selection from possible programs for carrying out the method according to the invention when using a spotlight constructed according to the invention for shooting films and videos. In particular, it is possible to carry out the described computation steps for determining the color locus from a user input, in which the color temperature or color correction or filter emulation is predetermined and the required brightness portions of the LED colors are subsequently determined therefrom, once outside the spotlight or the control device thereof and to store them in the form of tables in the memory of the spotlight or the control device thereof. The tables can contain for example the required brightness portions of the LED colors depending on the color locus or depending on the color temperature. Moreover, these tables can be calculated both for color-rendering-optimized settings and additionally for brightness-optimized settings and can be stored in the memory.

The invention claimed is:

1. A spotlight for use in shooting films and videos, said spotlight comprising: light-emitting diodes (LEDs) arranged on a light-emitting surface, wherein said LEDs emit different LED colors comprising the colors red, green, amber, blue and yellow and provide luminous flux portions for a color mixture, and wherein at least one LED comprises a luminescent LED; and a device for setting the luminous flux portion emitted by the LEDs, which device drives the LEDs at least in groups, wherein at least one color LED emits the LED color blue or cyan, and wherein the luminescent LED comprises a yellow-green, daylight-white, neutral-white or warm-white luminescent LED, which covers at least a portion of the color LEDs with the exception of the color LED emitting the LED color blue or cyan.

2. The spotlight of claim 1, wherein the individual color LEDs are arranged on a substrate with chip-on-board technology.

3. The spotlight of claim 2, wherein the individual color LEDs are embedded in microreflectors.

4. The spotlight of claim 1, wherein the LEDs are combined to form an LED module and the light-emitting surface of the spotlight comprises an LED board with an LED module or an array of LED modules.

5. The spotlight of claim 4, wherein the spotlight has a plurality of LEDs boards.

6. The spotlight of claim 4, wherein the LED modules have a predetermined number of color LEDs and luminescent LEDs, at least one color LED being provided for each LED color.

7. The spotlight of claim 1, wherein a luminescent material layer of the luminescent LED covers chips of the LEDs emitting a color red, green, orange, yellow-orange or yellow wavelength range which adjoin a chip of the luminescent LED, and in that one or a plurality of color LEDs emitting a blue or cyan-colored wavelength range are arranged around or alongside the luminescent material layer.

8. The spotlight of claim 1, wherein the LED modules have in each case at least five different LEDs, of which one LED is embodied as a yellow-green or white luminescent LED, one LED is embodied as a monochrome cyan-colored or blue color LED, one LED is embodied as a monochrome green color LED and two LEDs are embodied as different monochrome color LEDs with a red, orange, yellow-orange or yellow LED color (R, A, Ye).

9. The spotlight of claim 1, wherein the LED modules have a yellow-green or white luminescent LED, a monochrome blue color LED having a peak wavelength of 430 nm-480 nm, a monochrome green color LED having a peak wavelength of 505 nm-535 nm, a monochrome amber-colored color LED having a peak wavelength of 610 nm-640 nm, and a monochrome red color LED having a peak wavelength of 630 nm-660 nm.

10. The spotlight of claim 1, wherein the LED modules have a yellow-green or white luminescent LED, a monochrome cyan-colored color LED having a peak wavelength of 480 nm-515 nm, a monochrome green color LED having a peak wavelength of 505 nm-535 nm, a monochrome yellow color LED having a peak wavelength of 580 nm-610 nm, and a monochrome amber-colored color LED having a peak wavelength of 610 nm-640 nm.

11. The spotlight of claim 1, wherein the LED modules have a yellow-green or white luminescent LED, a monochrome cyan-colored color LED having a peak wavelength of 480 nm-515 nm, a monochrome green color LED having a peak wavelength of 505 nm-535 nm, a monochrome yellow color LED having a peak wavelength of 580 nm-610 nm, a monochrome amber-colored color LED having a peak wavelength of 610 nm-640 nm, and a monochrome blue color LED having a peak wavelength of 430 nm-480 nm.

12. The spotlight of claim 1, wherein the LED modules have a yellow-green or white luminescent LED, a monochrome cyan-colored color LED having a peak wavelength of 480 nm-515 nm, a monochrome green color LED having a peak wavelength of 505 nm-535 nm, a monochrome yellow color LED having a peak wavelength of 580 nm-610 nm, and a monochrome red color LED having a peak wavelength of 630 nm-660 nm.

13. The spotlight of claim 1, wherein the LED modules have a yellow-green or white luminescent LED, a monochrome cyan-colored color LED having a peak wavelength of 480 nm-515 nm, a monochrome green color LED having a peak wavelength of 505 nm-535 nm, a monochrome yellow color LED having a peak wavelength of 580 nm-610 nm, a monochrome red color LED having a peak wavelength of 630 nm-660 nm, and a monochrome blue color LED having a peak wavelength of 430 nm-480 nm.

14. The spotlight of claim 1, wherein the LED modules have a yellow-green or white luminescent LED, a monochrome cyan-colored color LED having a peak wavelength of 480 nm-515 nm, a monochrome green color LED having a peak wavelength of 505 nm-535 nm, a monochrome amber-colored color LED having a peak wavelength of 610 nm-640 nm, and a monochrome red color LED having a peak wavelength of 630 nm-660 nm.

15. The spotlight of claim 1, wherein the LED modules have a yellow-green or white luminescent LED, a monochrome cyan-colored color LED having a peak wavelength of 480 nm-515 nm, a monochrome green color LED having a peak wavelength of 505 nm-535 nm, a monochrome amber-colored color LED having a peak wavelength of 610 nm-640 nm, a monochrome red color LED having a peak wavelength of 630 nm-660 nm, and a monochrome blue color LED having a peak wavelength of 430 nm-480 nm.

16. The spotlight of claims 1, wherein the LED modules have a yellow-green or white luminescent LED, a monochrome blue color LED having a peak wavelength of 430 nm-480 nm, a monochrome green color LED having a peak wavelength of 505 nm-535 nm, a monochrome yellow color LED having a peak wavelength of 580 nm-610 nm, and a monochrome red color LED having a peak wavelength of 630 nm-660 nm.

17. The spotlight of claim 1, wherein the LED modules have a yellow-green or white luminescent LED, a monochrome blue color LED having a peak wavelength of 430 nm-480 nm, a monochrome red color LED having a peak wavelength of 630 nm-660 nm.

18. The spotlight of claim 1, wherein the spotlight is designed to simulate a light source and/or light color selected by a user.

19. The spotlight of claim 4, wherein at least one measuring device is arranged between the LED board and a front side of the spotlight.

20. The spotlight of claim 19, wherein the measuring device detects the radiation intensity of the LEDs and is embodied as a colorimeter, RGB sensor, V(λ) sensor or light sensor.

21. The spotlight of claim 20, wherein the measuring device is formed by at least five light sensors having different spectral sensitivities.

22. The spotlight of claim 20, wherein the measuring device detects the radiation intensity of the LEDs continuously or at predetermined time intervals.

23. The spotlight of claim 19, wherein the measuring device is regulated to a constant temperature.

24. The spotlight of claim 19, wherein a representative portion of each LED color is coupled into the light-sensitive surface of the measuring device.

25. The spotlight of claim 19, wherein a diffusing screen fitted in front of an array of LED modules collects light and couples part of the light into the measuring device via an opening in a peripheral reflective coating.

26. The spotlight of claim 19, wherein at least one LED module is a monitor LED module and is arranged at a thermally representative location of the array of LED modules and is used for illuminating the measuring device and part of a radiation emitted by the monitor LED module is coupled into the measuring device.

27. The spotlight of claim 26, wherein the light emitted by the monitor LED module irradiates onto a diffuser lamina and is reflected or guided onto the measuring device by the diffuser lamina.

28. The spotlight of claim 27, wherein the light is guided onto the measuring device by the diffuser lamina via an optical waveguide.

29. The spotlight of claim 27, wherein the diffuser lamina is arranged at the underside of a transparent screen arranged above the light-emitting surface of the spotlight.

30. The spotlight of claim 27, wherein the diffuser lamina is arranged in a capsule, which is placed onto one side of the light-emitting surface of the spotlight and which surrounds the monitor LED module and the measuring receiver.

31. The spotlight of claim 30, wherein the capsule is light-tight.

32. The spotlight of claim 30, wherein the monitor LED module, the measuring receiver and the capsule are arranged on the underside of the light-emitting surface of the spotlight.

33. The spotlight of claim 27, wherein the diffuser lamina has a reflective coating on a side remote from the measuring receiver.

34. The spotlight of claim 26, wherein the measuring device is situated at that end of a capsule which is remote from the monitor LED module, said capsule being arranged above the monitor LED module on a top side or underside of the light-emitting surface of the spotlight.

35. The spotlight of claim 1, wherein the LEDs are side-emitting LEDs.

36. The spotlight of claim 35, wherein the LEDs produce a constant luminance distribution on a surface illuminated by the LEDs.

37. The spotlight of claim 35, wherein a light guiding plate on the light-emitting surface of the spotlight, and the light emitted by the side-emitting LEDs is mixed by the light guiding plate.

38. The spotlight of claim 37, wherein the light guiding plate comprises a peripheral reflective coating.

39. The spotlight of claim 38, wherein an opening is situated in the peripheral reflective coating, wherein the measuring device is arranged in said opening.

40. The spotlight of claim 19, wherein the measurement of a radiation intensity of the individual LED colors is initiated manually.

41. The spotlight of claim 19, wherein an optical and/or acoustic signal device indicates the deviation of a present setting from a predetermined desired value.

42. The spotlight of claim 19 further comprising a user interface, wherein the desired color temperature and/or the desired color locus of the spotlight is set via the user interface.

43. The spotlight of claim 19 further comprising a user interface, wherein a color correction which emulates attached color correction filters, and/or a light color which emulates color filters, is selected via the user interface for simulation by the spotlight.

44. The spotlight of claim 1, wherein the spotlight is designed to adapt a color temperature depending on the brightness of the spotlight in a dimming mode.

45. A method for setting the color characteristics emitted by a spotlight for shooting films and videos with light-emitting diodes (LEDs) arranged on a light-emitting surface, of which color LEDs emit different LED colors and provide luminous flux portions for a color mixture, and at least one LED comprises a luminescent LED, wherein the spotlight comprises a device for setting the luminous flux portion emitted by the LEDs, which device drives the LEDs at least in groups, wherein at least one color LED emits an LED color blue or cyan, and in that the luminescent LED comprises a yellow-green, daylight-white, neutral-white or warm-white luminescent LED, which covers at least a portion of the color LEDs with the exception of the color LED emitting the LED color blue or cyan, wherein after the spotlight has been switched on, radiation components of the LED colors red, green, amber, blue and yellow (R, G, A, B, Ye) are measured, during operation, present RGB or intensity values of the LED colors R, G, A, B, Ye are measured continuously or at predetermined intervals, and the radiation intensity of the LED colors R, G, A, B, Ye is readjusted taking account of the present RGB or intensity values determined for each LED color R, G, A, B, Ye.

46. The method of claim 45, wherein a present color locus is calculated from the present RGB or intensity values of the total radiation of the LED colors R, G, A, B, Ye and, in the event of deviations from a target color locus, the present RGB or intensity values of the individual LED colors are measured, whereupon the radiation intensity of the LED colors R, G, A, B, Ye is readjusted taking account of the present RGB or intensity values determined for each LED color R, G, A, B, Ye.

47. The method claim 45, wherein the radiation components of the LED colors R, G, A, B, Ye are determined by successively activating the individual LED colors R, G, A, B, Ye one shortly after another and measuring the RGB or intensity values of the individual LED colors R, G, A, B, Ye.

48. The method of claim 45, wherein the radiation components of the LED colors R, G, A, B, Ye are determined by successively activating two or at most three LED colors (R, G, A, B, Ye), measuring the RGB or intensity values and calculating the intensities of the individual LED colors R, G, A, B, Ye.

49. The method of claim 45, wherein the radiation components of the LED colors R, G, A, B, Ye are determined by measuring the total radiation of all the LED colors, R, G, A, B, Ye successively switching off individual LED colors R, G, A, B, Ye, measuring the RGB or intensity values of the remaining LED colors R, G, A, B, Ye and subtracting the two values thus measured in order to determine the RGB or intensity values of the LED color R, G, A, B, Ye respectively switched off.

50. The method of claim 45, wherein the radiation components of the LED colors R, G, A, B, Ye are determined by measuring the total radiation of all the LED colors R, G, A, B, Ye by means of light sensors having different spectral sensitivities, wherein the number of light sensors correspond to the number of LED colors used.

51. The spotlight of claim 7 wherein said LEDs further emit the colors orange and yellow-orange and wherein said luminescent layer also covers chips of the LEDs emitting the colors orange and yellow-orange.

* * * * *